US010475393B2

(12) United States Patent
Lee et al.

(10) Patent No.: US 10,475,393 B2
(45) Date of Patent: Nov. 12, 2019

(54) ELECTROLUMINESCENT DISPLAY DEVICE

(71) Applicant: LG DISPLAY CO., LTD., Seoul (KR)

(72) Inventors: KyoungWon Lee, Goyang-si (KR); ChangHoon Jeon, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 15/826,000

(22) Filed: Nov. 29, 2017

(65) Prior Publication Data

US 2018/0151132 A1 May 31, 2018

(30) Foreign Application Priority Data

Nov. 30, 2016 (KR) ..... 10-2016-0161898

(51) Int. Cl.

| | |
|---|---|
| ***G09G 3/32*** | (2016.01) |
| ***G09G 3/34*** | (2006.01) |
| ***G09G 3/30*** | (2006.01) |
| *G09G 3/3258* | (2016.01) |
| *G09G 3/3233* | (2016.01) |
| *G09G 3/3266* | (2016.01) |

(52) U.S. Cl.

CPC ..... *G09G 3/3406* (2013.01); *G09G 3/30* (2013.01); *G09G 3/3233* (2013.01); *G09G 3/3258* (2013.01); *G09G 3/3266* (2013.01); *G09G 2300/0439* (2013.01); *G09G 2320/029* (2013.01); *G09G 2320/0626* (2013.01)

(58) Field of Classification Search

CPC ... G09G 3/3233; G09G 3/3258; G09G 3/3266

See application file for complete search history.

(56) References Cited

U.S. PATENT DOCUMENTS

| | | | | |
|---|---|---|---|---|
| 2014/0333673 | A1 | 11/2014 | Cho et al. | |
| 2017/0039935 | A1* | 2/2017 | Yang | G09G 3/32 |
| 2017/0301289 | A1* | 10/2017 | Jeong | G09G 3/3233 |
| 2018/0130408 | A1* | 5/2018 | Zhou | G09G 3/3208 |
| 2018/0268759 | A1* | 9/2018 | Wang | G09G 3/32 |

FOREIGN PATENT DOCUMENTS

KR 10-2014-0133326 A 11/2014

* cited by examiner

*Primary Examiner* — Joseph R Haley

(74) *Attorney, Agent, or Firm* — Birch, Stewart, Kolasch & Birch, LLP

(57) ABSTRACT

An electroluminescent display device includes a pixel area including a plurality of sub-pixels displaying an image signal at a specific refresh rate, a plurality of ELVDD lines electrically connected to the plurality of sub-pixels, a plurality of data lines electrically connected to the plurality of sub-pixels, a plurality of scan lines electrically connected to the plurality of sub-pixels, a plurality of EM lines electrically connected to the plurality of sub pixels, a scan driver sequentially supplying a scan signal to the plurality of scan lines and sequentially supplying an EM signal having a specific duty ratio pattern configured to control a dimming level of the pixel area to the plurality of EM lines, and a driving unit electrically connected to the plurality of data lines and the scan driver, and configured to control the dimming level according to a dimming control signal.

27 Claims, 8 Drawing Sheets

ELECTROLUMINESCENT DISPLAY DEVICE

CROSS REFERENCE TO RELATED APPLICATIONS

This application claims the priority benefit of the Korean Patent Application No. 10-2016-0161898 filed on Nov. 30, 2016, which is hereby incorporated by reference as if fully set forth herein.

BACKGROUND

Technical Field

The present disclosure relates to an electroluminescent display device and more in detail to an electroluminescent display device capable of adjusting its brightness by emitting light according to an emission signal having a specific duty ratio pattern during an emission period.

Related Technology

An electroluminescent display device is a self-emissive display device, unlike a liquid crystal display device, which does not require a separate light source, and can be manufactured in a thin and lightweight form. In addition, the electroluminescent display device has advantages such as fast response time, wide viewing angle, and infinite contrast ratio as well as power consumption according to low voltage driving.

A pixel area (AA) of an electroluminescent display device includes a plurality of sub-pixels. The sub-pixel includes an electro-luminescence diode (ELD). A periphery area (PA) is configured adjacent to the pixel area (AA).

An electro-luminescence diode includes an anode, an emission layer, and a cathode. A high-potential voltage ELVDD is supplied to the anode (i.e., the pixel electrode) through the driving transistor. A low-potential voltage ELVSS is supplied to the cathode (i.e., the common electrode).

The emission layer of the electro-luminescence diode may comprise an organic material and/or an inorganic material. When the emission layer is made of an organic material, it may be referred to as an organic light emitting diode (OLED), and when it is made of an inorganic material, it may be referred to as an inorganic light emitting diode (ILED). The inorganic material may be, for example, a quantum-dot and/or Nano-crystal material. The emission layer may be a structure in which the inorganic light emitting material and the organic light emitting material are mixed or stacked.

The sub-pixel adjusts it's brightness by adjusting the amount of current supplied to the electro-luminescence diode. The sub-pixel adjusts the amount of current supplied to the electro-luminescence diode according to the data voltage. The sub-pixel controls the electro-luminescence diode with at least two switching transistors, at least one driving transistor, and at least one storage capacitor.

A scan driver and/or a data driver are electrically connected in a peripheral area PA of the pixel area AA to drive sub-pixels.

The scan driver sequentially turns on or turns off the transistors of the plurality of sub-pixels. The scan driver is connected to the scan lines, which are connected to the transistors of the sub-pixels.

The data driver supplies the data voltage to the sub-pixel. The supplied data voltage is charged to the storage capacitor of the sub-pixel.

The brightness of the electro-luminescence diode is controlled by the charged data voltage and thus the image is displayed.

The brightness of the electroluminescent display device is displayed in accordance with the gradation (i.e., gray level) of the digital video signal. The brightness gradation of the electroluminescent display device is adjusted between minimum brightness (e.g., minimum 0 nit) and maximum brightness (e.g., maximum 1000 nit). The gradations of the electroluminescent display device vary depending on the format of the image signal. For example, a video signal of 8-bit format can display gradations of 256 steps and a video signal of 10-bit format can display gradations of 1024 steps.

SUMMARY

The inventors of the present disclosure have studied and developed an electroluminescent display device capable of varying a dimming level in various ways. In detail, the inventors of the present disclosure studied various characteristics of electroluminescent display devices in order to improve the dimming level control capability of the electroluminescent display device.

The inventors of the present disclosure have implemented global dimming technique by adjusting the maximum voltage level of the gamma voltage curve corresponding to the gradations in order to vary the dimming level of the electroluminescent display device. For instance, to adjust the maximum voltage of the gamma voltage curve, the specific reference voltage of the reference voltage supply unit is stepped up or stepped down. However, the inventors of the present disclosure have recognized that there is a difficulty in generating a desired voltage for each frame because the step-up and step-down of the reference voltage requires boosting.

Accordingly, the inventors of the present disclosure have developed a special pulse width modulation (PWM) technique to control the dimming level. However, the inventors of the present disclosure have recognized that when the PWM is applied to decrease the dimming level, flicker level can be increased. And, the inventors of the present disclosure have recognized that in order to control the turn-on duty ratio, duty ratio waveforms that can control the respective dimming levels must be generated. That is, the electroluminescent display device is configured to generate n PWM waveforms having different duty ratios in order to adjust the dimming level to n steps, wherein n is a natural number greater than or equal to 2.

Accordingly, an object of the present disclosure is to provide an electroluminescent display device capable of providing finer dimming levels while reducing a flicker of an electroluminescent display device by providing a specific duty ratio pattern.

Accordingly, another object of the present disclosure is to provide an electroluminescent display device capable of providing a detailed dimming level while reducing a flicker of an electroluminescent display device by providing a specific duty ratio pattern in which a duty ratio pattern is coded.

It should be noted that objects of the present disclosure are not limited to the above-described objects, and other objects of the present disclosure will be apparent to those skilled in the art from the following descriptions.

According to an embodiment of the present disclosure, there is provided an electroluminescent display device which may comprise a pixel area including a plurality of sub-pixels displaying an image signal at a specific refresh rate, a plurality of ELVDD lines electrically connected to the plurality of sub-pixels, a plurality of data lines electrically connected to the plurality of sub-pixels, a plurality of scan lines electrically connected to the plurality of sub-pixels, a plurality of EM lines electrically connected to the plurality of sub-pixels, a scan driver sequentially supplying a scan signal to the plurality of scan lines and sequentially supplying an EM signal having a specific duty ratio pattern configured to control a dimming level of the pixel area to the plurality of EM lines, and a driving unit, electrically connected to the plurality of data lines and the scan driver, and configured to control the dimming level according to a dimming control signal.

According to another embodiment of the present disclosure, there is provided an electroluminescent display device which may comprise a circuit unit adjusting a maximum voltage value of a gamma voltage curve corresponding to a gray level for varying a dimming level of the electroluminescent display device and generating an EM signal having a specific duty ratio pattern for realizing a global dimming. The EM signal having the specific duty ratio pattern provides a fine dimming level while reducing image flicker.

The details of other embodiments are included in the detailed description and drawings.

According to embodiments of the present disclosure, it is possible to provide a finer dimming level while reducing flicker by an EM signal having a specific duty ratio pattern.

In addition, according to embodiments of the present disclosure, there is an advantage that a specific duty ratio pattern in which the duty ratio pattern is coded is provided, and the detailed dimming level can be efficiently provided while reducing the flicker of the electroluminescent display device.

The effects according to the embodiments of the present disclosure are not limited by the contents described above, and more various effects are included in the detailed description.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE PRESENT DISCLOSURE

Figure 1:
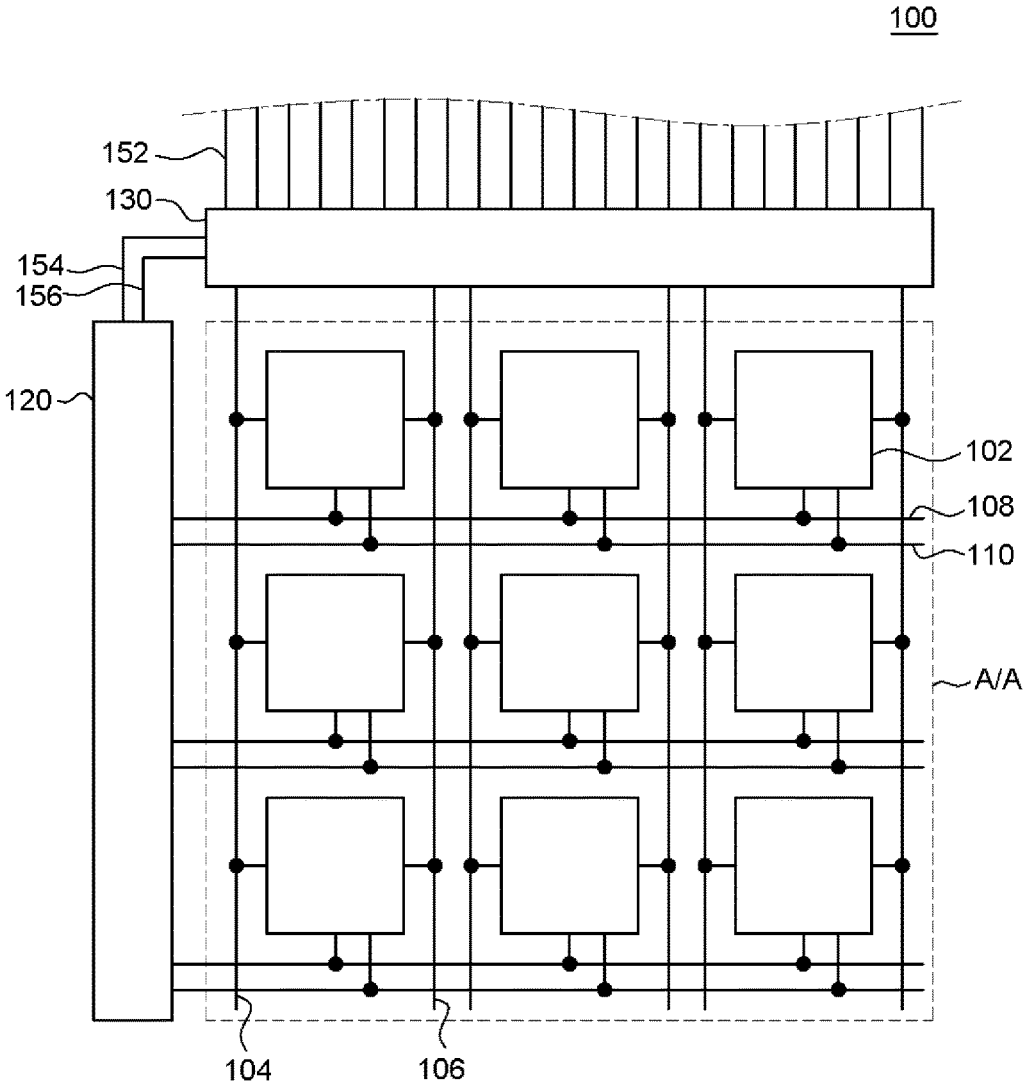
FIG. 1 is a schematic plan view illustrating an electroluminescent display device according to an embodiment of the present disclosure.

Advantages and features of the present disclosure and methods for accomplishing the same will be more clearly understood from exemplary embodiments described below with reference to the accompanying drawings. However, the present disclosure is not limited to the following exemplary embodiments but may be implemented in various different forms. The exemplary embodiments are provided only to complete disclosure of the present disclosure and to fully provide a person having ordinary skill in the art to which the present disclosure pertains with the category of the invention and the present invention will be defined by the appended claims.

The shapes, sizes, ratios, angles, numbers and the like illustrated in the accompanying drawings for describing the exemplary embodiments of the present disclosure are merely examples and the present disclosure is not limited thereto. Like reference numerals generally denote like elements throughout the present specification. And, in the following description, a detailed explanation of known related technologies may be omitted to avoid unnecessarily obscuring the subject matter of the present disclosure. The terms such as "including", "having", "comprising" and "consist of" used herein are generally intended to allow other components to be added unless the terms are used with the term "only". Any references to singular may include plural unless expressly stated otherwise.

Components are interpreted to include an ordinary error range or an ordinary tolerance range even if not expressly stated.

When the position relation between two parts is described using the terms such as "on", "above", "below" and "next", one or more parts may be positioned between the two parts unless the terms are used with the term "immediately" or "directly".

When an element or layer is referred to as being "on" another element or layer, it may be directly on the other element or layer, or intervening elements or layers may be present.

Although the terms "first", "second" and the like are used for describing various components, these components are not confined by these terms. These terms are merely used for distinguishing one component from the other components. Therefore, a first component to be mentioned below may be a second component in a technical concept of the present disclosure.

Throughout the whole specification, the same reference numerals denote the same elements.

Since size and thickness of each component illustrated in the drawings are represented for convenience in explanation, the present disclosure is not necessarily limited to the illustrated size and thickness of each component.

The features of various embodiments of the present disclosure can be partially or entirely bonded to or combined with each other and can be interlocked and operated in technically various ways as can be fully understood by a person having ordinary skill in the art, and the embodiments can be carried out independently of or in association with each other.

Various embodiments of the present disclosure will be described in detail with reference to the accompanying drawings.

FIG. 1 is a schematic plan view illustrating an electroluminescent display device 100 according to an embodiment of the present disclosure. All the components of the electroluminescent display device according to all embodiments of the present disclosure are operatively coupled and configured.

Figure 2:
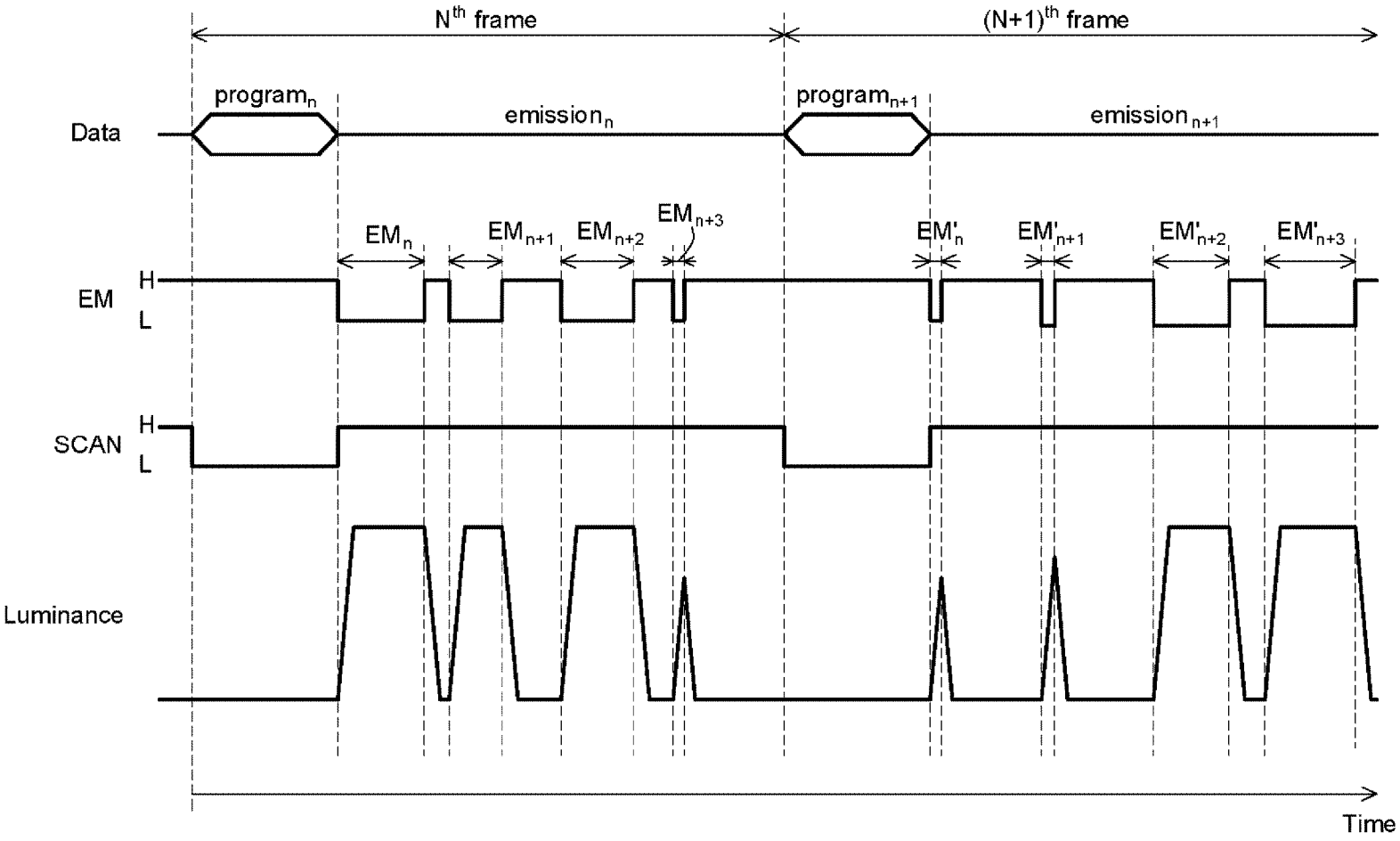
FIG. 2 is a schematic waveform diagram illustrating an operation of an electroluminescent display device according to an embodiment of the present disclosure.

FIG. 2 is a schematic waveform diagram illustrating an operation of an electroluminescent display device 100 according to an embodiment of the present disclosure.

Hereinafter, the electroluminescent display device 100 according to an embodiment of the present disclosure will be described in detail with reference to FIGS. 1 and 2.

The electroluminescent display device 100 according to an embodiment of the present disclosure may be realized as a top-emission type in which light can be emitted to the upper side, a bottom-emission type in which light can be emitted to the lower side, and a dual-emission type in which light can be emitted to the upper side and/or the lower side. In addition, the electroluminescent display device 100 may be implemented as a transparent display device and/or a flexible display device. But the present disclosure is not limited thereto.

Referring to FIG. 1, the electroluminescent display device 100 is formed on a substrate. The substrate may be made of glass, plastic, metal with an insulating film, ceramic, or the like. The substrate supports various components of the electroluminescent display device. But the present disclosure is not limited thereto.

A plurality of sub-pixels 102 including transistors are formed on a substrate of an electroluminescent display device 100 according to an embodiment of the present disclosure.

According to an embodiment of the present disclosure, an electroluminescent display device 100 operates using various voltages. The electroluminescent display device 100 may receive various reference voltages generated by the reference voltage supply unit. The reference voltage supply unit may be a voltage generating circuit such as a DC-DC converter or the like and may generate an ELVDD voltage, an ELVSS voltage, a reference voltage, a HIGH voltage, a LOW voltage and various clock signals (CLK) that may be required for driving logics of the driving unit 130. But the present disclosure is not limited thereto, and the driving unit 130 may be referred to as a circuit unit.

That is, the electroluminescent display device 100 according to an embodiment of the present disclosure may be configured to receive various voltages from a reference voltage supply unit that may be configured in various ways.

In some embodiments, the reference voltage supply unit may be configured as a part of the electroluminescent display device 100 or as a part of an external system.

According to an embodiment of the present disclosure, the PAD line (i.e., PAD signal line) 152 of the electroluminescent display device 100 electrically connects the driving unit 130 and the external system. The driving unit 130 can receive various control signals and various reference voltages from an external system through the PAD line 152. For example, the driving unit 130 may receive an image signal transmitted from an external system and display an image. The video signal may be a digital format signal (e.g., 6-bit, 8-bit and 10-bit). But the present disclosure is not limited thereto.

The PAD line 152 may be electrically connected to the substrate through a pad formed on the substrate. For example, when the PAD line 152 is mounted, an anisotropic conductive film (ACF) or the like may be used as the conductive adhesive. The PAD line 152 may be a printed circuit board or a flexible circuit board. But the present disclosure is not limited thereto.

In some embodiments, the driving unit 130 may be formed or mounted on the PAD line 152.

In some embodiments, the electroluminescent display device may comprise a system. In this case, the electroluminescent display device and the system are integrated, and the integrated electroluminescent display device can directly supply a video signal.

The pixel area AA of the electroluminescent display device 100 according to an embodiment of the present disclosure is indicated by a dotted rectangle for convenience of explanation. The pixel area AA means a substantial area capable of displaying an image. But the present disclosure is not limited thereto.

The plurality of sub-pixels 102 of the electroluminescent display device 100 according to an embodiment of the present disclosure may be configured to emit at least three different colors to display various colors. For example, the sub-pixel 102 may be configured to emit light of one of red, green and blue, or may be configured to emit light of one of red, green, blue and white. But the present disclosure is not limited thereto.

Each sub-pixel 102 may include an electro-luminescence diode or may be electrically connected to the electro-luminescence diode. The electro-luminescence diode may include an anode, an emission layer, and a cathode. The high-potential voltage ELVDD may be supplied to the anode through the driving transistor. The low-potential voltage ELVSS is supplied to the cathode (i.e., common electrode). The cathode may be formed to cover the pixel area AA. But the present disclosure is not limited thereto.

The emission layer of the electro-luminescence diode may comprise an organic material and/or an inorganic material. When the emission layer is made of an organic material, it may be referred to as an organic light emitting diode (OLED), and when it is made of an inorganic material, it may be referred to as an inorganic light emitting diode (ILED). The inorganic material may be, for example, a quantum-dot and/or Nano-crystal material. The emission layer may be a structure in which the inorganic light emitting material and the organic light emitting material are mixed or stacked. But is not limited thereto.

The plurality of sub-pixels 102 are electrically connected to various lines (i.e., signal lines) and are driven by receiving various signals. Generally, three or four sub-pixels configure one pixel, and a plurality of pixels are implemented in an array or a matrix in a pixel area. Here, the number, shape, arrangement, etc. of the sub-pixels configuring one pixel may be various and may be suitably implemented according to the size, use, characteristics, etc. of the electroluminescent display device. Each sub-pixel 102 adjusts the brightness of the sub-pixel by adjusting the amount of current supplied to the electro-luminescence diode. The sub-pixel 102 adjusts the amount of current supplied to the electro-luminescence diode according to the data voltage level. The sub-pixel 102 may control the electro-luminescence diode using at least two switching transistors, at least one driving transistor, and at least one storage capacitor. But the present disclosure is not limited thereto.

In some embodiments, the pixel area AA may be configured of regions of various shapes such as a circle, an ellipse, a rectangle, a square, and a triangle.

According to an embodiment of the present disclosure, the driving unit 130 of the electro-luminescence display device 100 is electrically connected to the scan driver 120, the plurality of sub-pixels 102, and the pad lines 152.

In some embodiments, at least one of the lines arranged in the above-described pixel area AA can be extended as if passing through the sub-pixel, instead of being arranged at the outer periphery of the sub-pixel. In such a case, an insulating film having an insulating property may be used so that an electrical short is not generated with the sub-pixel.

In some embodiments, the driving unit may further include various compensation circuits capable of compensating a plurality of sub-pixels. When the driving unit includes the compensation circuit, the threshold voltage deviation of the driving transistor of the sub-pixel in the driving unit can be compensated by the external compensation technique. In this case, a sensing line electrically connecting the driving unit and the sub-pixel can be further included and the threshold voltage Vth of the sub-pixel may be sensed through the sensing line and a value obtained by compensating the threshold voltage deviation may be reflected in the data voltage.

In some embodiments, the driving unit senses the degree of deterioration of the electro-luminescence diode of the sub-pixel, and reflects a value obtained by compensating the deterioration deviation to the data voltage.

The ELVDD line 106 of the electroluminescent display device 100 according to an embodiment of the present disclosure supplies the high potential voltage ELVDD to the plurality of sub-pixels 102. The plurality of sub-pixels 102 are supplied with the ELVDD voltage through the ELVDD line 106. The ELVDD line 106 can be formed of a material having a low electrical resistance. But the present disclosure is not limited thereto.

For example, the ELVDD line 106 may be made of a metal material. But the present disclosure is not limited thereto.

For example, the ELVDD line 106 extends in the first direction such that the ELVDD line 106 and the adjacent sub-pixel 102 are electrically interconnected. But the present disclosure is not limited thereto.

For example, both the data line 104 and the ELVDD line 106 may extend in the first direction and the data line 104 and the ELVDD line 106 may be parallel. But the present disclosure is not limited thereto.

The ELVDD line 106 may be configured to receive the ELVDD voltage directly from the driving unit 130 or the reference voltage supply unit. But the present disclosure is not limited thereto.

For example, the data line 104 and the ELVDD line 106 may be formed of the same metal layer. But the present disclosure is not limited thereto.

For example, the data line and the ELVDD line may extend along the first direction and may be alternatively arranged at a predetermined distance apart from each other in the second direction. But the present disclosure is not limited thereto.

For example, the data line 104 and the ELVDD line 106 may be disposed on the first side of the sub-pixel 102. But the present disclosure is not limited thereto.

For example, the data line 104 may be disposed on the first side of the sub-pixel 102, and the ELVDD line 106 may be disposed on the second side of the sub-pixel 102. But the present disclosure is not limited thereto.

In some embodiments, the data line and the ELVDD line may be formed of different metal layers.

In some embodiments, the data line and the ELVDD line may extend in different directions.

In some embodiments, the ELVDD line may be formed in the form of a mesh structure extending in the first direction and the second direction.

The driving unit 130 of the electroluminescent display device 100 receives a video signal from an external system according to an embodiment of the present disclosure. The driving unit 130 converts a digital video signal into a data voltage (i.e., an analog video signal). The driving unit 130 may include a gamma voltage generator for generating a data voltage or may be electrically connected to a separate gamma voltage generator.

For example, the driving unit 130 may perform a function of adjusting the timing of each of the signals for supplying the data voltages corresponding to the respective sub-pixels 102.

That is, the driving unit 130 may be referred as a circuit unit that performs a function of a data driver, a function of a timing controller, or a function of both a data driver and a timing controller. But the present disclosure is not limited thereto.

In addition, the gamma voltage may be referred as a voltage corresponding to each gray level of a video signal. The gamma voltage generator may convert a digital video signal to an analog data voltage using a digital to analogue converter (DAC). But the present disclosure is not limited thereto.

The data line 104 of the electroluminescent display device 100 electrically connects the plurality of sub-pixels 102 and the driver 130 according to an embodiment of the present disclosure. The converted analog data voltage is supplied to the plurality of sub-pixels 102 through the plurality of data lines 104. That is, the plurality of sub-pixels 102 receives the data voltage through the data line 104.

According to an embodiment of the present disclosure, the data line 104 of the electroluminescent display device 100 may be formed of a material having a low electrical resistance. For example, the data line 104 may comprise a metal material (e.g., a first metal layer or a second metal layer). The data line 104 extends in a first direction (e.g., the vertical direction) and is electrically connected to the data line 104 and the adjacent sub-pixel 102. But the present disclosure is not limited thereto.

In some embodiments, the plurality of data lines 104 may extend in a second direction that intersects the first direction.

According to an embodiment of the present disclosure, the driving unit 130 of the electroluminescent display device 100 is disposed outside the pixel area AA. For example, the driving unit 130 may be disposed on a peripheral area formed outside the pixel area AA on the substrate.

In some embodiments, the driving unit 130 may be mounted on a printed circuit board or a flexible circuit board. For example, the driving unit 130 can be mounted using a conductive adhesive such as an anisotropic conductive film.

In some embodiments, the driving unit 130 may be formed in the peripheral area by a semiconductor manufacturing process.

In some embodiments, the driving unit 130 may be mounted on a peripheral area.

In some embodiments, at least a portion of the driving unit 130 may be included in an external system electrically coupled to the pixel area AA.

According to an embodiment of the present disclosure, the driving unit 130 of the electroluminescent display device 100 supplies the scan control signal and the EM control signal to the scan driver 120 thereby controlling the output of the scan driver 120 (i.e., scan signal (SCAN) and EM signal (EM)).

According to an embodiment of the present disclosure, the scan control line 154 of the electroluminescent display device 100 electrically connects the driving unit 130 and the scan driver 120 and supplies the output scan control signal from the driving unit 130 to the scan driver 120.

According to an embodiment of the present disclosure, the scan driver 120 of the electroluminescent display device 100 is electrically connected to the plurality of scan lines 108. The scan driver 120 sequentially outputs a scan signal SCAN to the plurality of scan lines 108 in response to a scan control signal applied from the driver 130. The waveform of the scan signal SCAN output from the scan driver 120 is determined according to the waveform of the scan control signal input from the driver 130.

According to an embodiment of the present disclosure, the scan driver 120 of the electroluminescent display device 100 is electrically connected to the plurality of scan lines 108. The scan driver 120 sequentially outputs a scan signal SCAN to the plurality of scan lines 108 in response to a scan control signal applied from the driving unit 130. The waveform of the scan signal SCAN output from the scan driver 120 is determined according to the waveform of the input scan control signal from the driving unit 130.

According to an embodiment of the present disclosure, the scan driver 120 of the electroluminescent display device 100 includes a plurality of shift registers. The shift register sequentially transmits turn-on pulses to the plurality of scan lines 108 and the plurality of EM lines 110.

For example, the pixel area AA may be a plurality of sub-pixels 102 arranged in (n rows)×(m columns) matrix. And, the scan driver 120 may include n shift registers. That is, one shift register supplies the scan signal SCAN and the EM signal EM to one row of the pixel area AA. But the present disclosure is not limited thereto.

For example, the plurality of scan lines 108 may be configured to sequentially output the scan signal (SCAN) from the uppermost scan line to the lowermost scan line. But the present disclosure is not limited thereto.

For example, the plurality of scan lines 108 may be configured to sequentially output the scan signals SCAN from the lowermost scan line to the uppermost scan line. But the present disclosure is not limited thereto.

For example, the scan control signal may be a Svst (Scan Vertical Start) signal. At this time, the Svst signal may be referred as a signal indicating the start of one image frame of the video signal. In this case, the Svst signal is input to the shift register on the uppermost side of the scan driver 120, and the scan line 108 connected to the uppermost shift register outputs the scan signal SCAN. And, the Svst signal is transferred to the lower shift register adjacent to the uppermost shift register. Therefore, the scan line 108 connected to the adjacent lower shift register outputs a scan signal SCAN. That is, each of the shift registers of the scan driver 120 is configured to sequentially transmit the Svst signal through the adjacent shift registers. Accordingly, the plurality of scan lines 108 connected to the scan driver 120 can sequentially output the scan signals SCAN.

In some embodiments, the plurality of sub-pixels 102 of the pixel area may be arranged in a matrix of (n rows)×(m columns). The scan driver 120 may include n first shift registers and n second shift registers. That is, one first shift register supplies a scan signal SCAN to one row of one sub-pixel 102 in the pixel area. And, one second shift register supplies the EM signal EM to one row of the pixel area. But the present disclosure is not limited thereto.

According to an embodiment of the present disclosure, the scan lines 108 of the electroluminescent display device 100 may be formed of a material having a low electrical resistance. For example, the scan lines 108 may be made of a metallic material (e.g., a first metal layer or a second metal layer). But the present disclosure is not limited thereto.

The scan lines 108 extend in a second direction (e.g., a horizontal direction) that intersects the first direction, and the scan lines 108 and the adjacent sub-pixels 102 are electrically connected. But the present disclosure is not limited thereto.

In some embodiments, the plurality of scan lines 108 may extend in a first direction.

According to an embodiment of the present disclosure, the EM control line 156 of the electroluminescent display device 100 electrically connects the driving unit 130 and the scan driver 120 and outputs the EM control signal output from the driving unit 130 to the scan driver 120.

According to an embodiment of the present disclosure, the scan driver 120 of the electroluminescent display device 100 is electrically connected to the plurality of EM lines 110. The scan driver 120 sequentially outputs an EM signal EM to a plurality of EM lines 110 in response to an EM control signal applied from the driver 130. The waveform of the EM signal EM output from the scan driver 120 is determined according to the waveform of the EM control signal input from the driving unit 130.

For example, the plurality of EM lines 110 can sequentially output the EM signal EM from the uppermost scan line to the lowermost scan line.

For example, the plurality of EM lines 110 can sequentially output the EM signal EM from the lowermost scan line to the uppermost scan line.

For example, the EM control signal may be an Evst (Emission Vertical Start) signal. At this time, the Evst signal may be referred as a signal for controlling the dimming level of one image frame of the video signal.

That is, each of the shift registers of the scan driver 120 is configured to sequentially transmit Evst signals through adjacent shift registers. Therefore, the plurality of EM lines 110 connected to the scan driver 120 can sequentially output the EM signal EM.

In this case, the Evst signal is input to the shift register on the uppermost side of the scan driver 120, and the EM line 110 connected to the uppermost shift register outputs the EM signal EM. And, the Evst signal is transferred to the lower shift register adjacent to the uppermost shift register. Therefore, the EM line 110 connected to the adjacent lower shift register outputs an EM signal EM. That is, each of the shift registers of the scan driver 120 is configured to sequentially transmit the Evst signal through the adjacent shift registers. Accordingly, the plurality of EM lines 110 connected to the scan driver 120 can sequentially output the EM signals EM.

According to an embodiment of the present disclosure, the EM line 110 of the electroluminescent display device 100 may be formed of a material having a low electrical resistance. For example, the EM line 108 may comprise a metallic material (e.g., a first metal layer or a second metal layer). But the present disclosure is not limited thereto. The EM line 110 extends in a second direction that intersects the first direction, and the EM line 110 and the adjacent sub-pixel 102 are electrically connected. But the present disclosure is not limited thereto.

In some embodiments, the plurality of EM lines 110 may extend in a first direction.

According to an embodiment of the present disclosure, the scan driver 120 of the electroluminescent display device 100 is disposed outside the pixel area AA. For example, the scan driver 120 may be formed on a peripheral area formed on the substrate outside the pixel area AA. For example, the scan driver 120 may be formed in the peripheral area by the transistor manufacturing process of the sub-pixel 102. But the present disclosure is not limited thereto.

In some embodiments, the scan driver 120 may be mounted on a printed circuit board, a flexible circuit board and/or a peripheral area. For example, when the scan driver 120 is mounted, an anisotropic conductive film or the like may be used as the conductive adhesive.

In some embodiments, the scan line 108 and the EM line 110 may be formed of different metal layers.

In some embodiments, a third metal layer may be further included, and at least one of the scan lines 108 and the EM lines 110 may be formed of the third metal layer.

In some embodiments, the scan lines 108 and the EM lines 110 may extend along the second direction and alternatively arranged at a predetermined distance apart from each other in the first direction.

Hereinafter, the operation of the electroluminescent display device 100 according to an embodiment of the present disclosure will be described in detail with reference to FIG. 2

The X-axis in FIG. 2 represents Time domain. Data shown on the Y-axis represents the data voltage waveform according to the time of the X-axis. The EM shown on the Y-axis represents the EM signal EM output by the scan driver 120 according to the X-axis time. The SCAN shown on the Y-axis represents a scan signal SCAN output from the scan driver 120 according to the X-axis time. The Luminance shown on the Y-axis represents the brightness (e.g., nits) of the sub-pixel 102 according to the X-axis time.

The X-axis in FIG. 2 can be divided into frames. For example, $(N)^{th}$ frame means the $N^{th}$ image frame period (e.g., frame interval). Here, $(N+1)^{th}$ frame preferably means the $(N+1)^{th}$ image frame period. The video signal is updated every predetermined frame period. For example, the refreshing frequency (e.g., refresh rate or frame rate) of the video signal may be 60 Hz. In this case, one frame period can be 16.7 ms. However, the present disclosure is not limited thereto, and the frame period may be variously variable. It is assumed that the frame period is repeated, only two frame periods are illustrated as an example in FIG. 2. However, the present disclosure is not limited thereto. Also, the values of various signals operating in each frame period may be different for each frame period, but the redundant features may be omitted for the sake of convenience of explanation. In addition, FIG. 2 is described with reference to one sub-pixel 102 corresponding to one EM line 110 and one scan line 108 for the sake of convenience of explanation. But the present disclosure is not limited thereto and other variations are part the present disclosure.

According to an embodiment of the present disclosure, each frame period of the electroluminescent display device 100 includes a programming period. The programming period is a period for applying the data voltage to the sub-pixel 102.

For example, the $(N)^{th}$ frame period includes a programming period $program_n$ in which a data voltage corresponding to $(N)^{th}$ frame is applied to the sub-pixel 102. The $(N+1)^{th}$ frame period, which is a next frame period, includes a programming period $program_{n+1}$ in which a data voltage corresponding to $(N+1)^{th}$ frame is applied to the sub-pixel 102.

In each programming period, the scan signal SCAN applied to the scan line 108 has a turn-on voltage. For example, when the transistor of the sub-pixel 102 that controls the scan signal SCAN is a PMOS transistor, the low level becomes the turn-on voltage. Conversely, in the case of an NMOS transistor, the high level becomes the turn-on voltage. Hereinafter, it is assumed that the transistor is a PMOS transistor. But the present disclosure is not limited thereto.

The sub-pixels 102 connected to the scan line 108 are turned on by the applied scan signal SCAN of the turn-on voltage. Therefore, each sub-pixel 102 is turned on according to the scan signal SCAN supplied with the respective data voltage through the electrically connected data lines 104.

When the scan signal SCAN switches to the turn-off voltage at the end of the programming period, the input data voltage is stored (i.e., charged) in the sub-pixel 102.

In addition, during the programming period, the EM signal EM maintains the turn-off voltage. Therefore, the electro-luminescence diode connected to the sub-pixel 102 may not emit light. But the present disclosure is not limited thereto.

According to an embodiment of the present disclosure, each frame period of the electroluminescent display device 100 includes an emission period having an emission duty ratio pattern. In each frame period, the emission period is located after the programming period in time. The emission period may be referred to as a period having an emission duty ratio pattern capable of controlling the emission of the electro-luminescence diode according to the data voltage charged in the sub-pixel 102.

For example, the $(N)^{th}$ frame period includes an emission period $emission_n$ for controlling the light emission duty ratio pattern of the electro-luminescence diode that emits light according to the data voltage charged in the $(N)^{th}$ frame. And, the $(N+1)^{th}$ frame period which is the next frame period, includes an emission period $emission_{n+1}$ for controlling the light emission duty ratio pattern of the electro-luminescence diode that emits light according to the data voltage charged in the $(N+1)^{th}$ frame.

In each of the emission periods, the EM signal EM applied to the EM line 110 is switched to the turn-on voltage according to the emission duty ratio pattern. For example, when the transistor of the sub-pixel 102 that controls the EM signal EM is a PMOS transistor, the low level becomes the turn-on voltage. Conversely, in the case of an NMOS transistor, the high level becomes the turn-on voltage. Hereinafter, it is assumed that the transistor is a PMOS transistor. But the present disclosure is not limited thereto.

The sub-pixels 102 connected to the EM line 110 to which the EM signal EM having the emission duty ratio pattern is applied, that is, the electro-luminescence diode included in the sub-pixel 102 emits light.

When the EM signal EM is switched to the turn-off voltage at the end of the emission period, the sub-pixel 102 does not emit light until the next emission period.

In other words, the scan signal SCAN maintains the turn-off voltage during the emission period. Therefore, the data voltage applied to the sub-pixel 102 can be kept charged. But the present disclosure is not limited thereto.

According to an embodiment of the present disclosure, the electro-luminescence diode of the electroluminescent display device 100 may be configured to emit light in response to a plurality of EM turn-on pulses (e.g., $EM_n$, $EM_{n+1}$, $EM_n+_2$, $EM_{n+3}$). Thus, the emission duty ratio of the electro-luminescence diode corresponds to the turn-on duty ratio of the EM turn-on pulse.

According to an embodiment of the present disclosure, the duty ratios of the plurality of EM turn-on pulses of the electroluminescent display device 100 are set different from each other. For example, when the number of EM turn-on pulses in each frame period may be configured with four pulses, the first turn-on pulse $EM_n$ has a first duty ratio, the second turn-on pulse $EM_{n+1}$ has a second duty ratio, the third turn-on pulse $EM_{n+2}$ has a third duty ratio, and the fourth turn-on pulse $EM_{n+3}$ has a fourth duty ratio.

Referring to FIG. 2, the start point of each EM turn-on pulse may be distributed at a specific point in the emission period. For example, the first turn-on pulse $EM_n$ is turned on at the start time of the emission period $emission_n$, the second turn-on pulse $EM_{n+1}$ is turned on at the ¼ time point of the emission period $emission_n$, the third turn-on pulse $EN_{n+2}$ is turned on at the ⅔ time point of the emission period $emission_n$, and the fourth turn-on pulse $EM_{n+3}$ is turned on at the ¾ time point of the emission period $emission_n$. But the present disclosure is not limited thereto. However, the point at which each EM turn-on pulse ends may vary depending on the duty ratio of each EM turn-on pulse.

When the refresh rate of the video signal of the electroluminescent display device 100 is 60 Hz as described above in one emission period as an example, the number of the EM turn-on pulses output from the scan driver 120 may be four as an example. In this case, the refresh rate of the EM signal EM of the electroluminescent display device 100 according to an embodiment of the present disclosure may be defined as 240 Hz. But the present disclosure is not limited to the refresh rate of the video signal and the refresh rate of the EM signal.

In some embodiments, when the refresh rate of the video signal of the electroluminescent display device is 60 Hz as an example, the number of EM turn-on pulses output from the scan driver in one emission period may be two as an example. In this case, the refresh frequency of the EM signal EM may be defined as 120 Hz.

In some embodiments, when the refresh rate of the video signal of the electroluminescent display device is 60 Hz as an example, the number of EM turn-on pulses output from the scan driver in one emission period may be eight as an example. In this case, the refresh frequency of the EM signal EM may be defined as 480 Hz.

In some embodiments, when the refresh rate of the video signal of the electroluminescent display device is 120 Hz as an example, the number of EM turn-on pulses output from the scan driver in one emission period may be three as an example. In this case, the refresh frequency of the EM signal EM may be defined as 360 Hz.

In some embodiments, the refresh rate of the video signal and the refresh rate of the EM signal EM of the electroluminescent display device may be variously set.

In other words, since the EM signal EM of the electroluminescent display device according to the embodiments of the present disclosure is configured to include a plurality of EM turn-on pulses, the refresh rate of the EM signal EM is set to be higher than the refresh rate of the video signal.

If the refresh rate of the video signal of the display device according to the comparative example is made equal to the refresh rate of the EM signal, the emission period has only one EM turn-on pulse. Therefore, the display device according to the comparative example cannot implement a specific emission duty ratio pattern in which the duty ratio of a plurality of EM turn-on pulses is set different from each other according to the embodiments of the present disclosure.

Hereinafter, specific emission duty ratio patterns according to specific turn-on duty ratio patterns of the electroluminescent display device 100 according to an embodiment of the present disclosure will be described in detail.

However, FIG. 2 is illustrating with respect to the specific turn-on duty ratio pattern, it can be assumed that the video signal, that is, the data voltage applied to all the frames to be the same for the sake of convenience of explanation. In the following description, it is assumed that the data voltages applied to the $(N)^{th}$ frame period and the $(N+1)^{th}$ frame period are equal to each other. But the present disclosure is not limited thereto.

According to an embodiment of the present disclosure, the electro-luminescence diode of the sub-pixel 102 of the electroluminescent display device 100 starts emitting light when the EM turn-on pulse is turned on. At this time, the response speed of the electro-luminescence diode may be slower than the response speed of the EM turn-on pulse. But the present disclosure is not limited thereto.

For example, in the $(N)^{th}$ frame period, the brightness of the electro-luminescence diode gradually increases from a start point of the first turn-on pulse $EM_n$ for a certain time. When the brightness increases up to the brightness corresponding to the charged data voltage, the brightness is maintained during the remaining first turn-on pulse $EM_n$. However, the present disclosure is not limited thereto, and when the leakage current occurs in the storage capacitor of the sub-pixel 102, a gradual brightness decrease due to the leakage current may be occurred during the first turn-on pulse $EM_n$. When the first turn-on pulse $EM_n$ is turned off, the brightness of the electro-luminescence diode gradually decreases for a certain time and is turned off.

Then, the brightness of the electro-luminescence diode gradually increases from the start point of the second turn-on pulse $EM_{(n+1)}$ for a certain time. When the brightness increases to the brightness corresponding to the charged data voltage, the brightness is maintained during the remaining second turn-on pulse $EM_{(n+1)}$. However, the present disclosure is not limited thereto and when the leakage current occurs in the storage capacitor of the sub-pixel 102, a gradual brightness decrease due to the leakage current may be occurred during the second turn-on pulse $EM_{(n+1)}$. When the second turn-on pulse $EM_{(n+1)}$ is turned off, the brightness of the electro-luminescence diode gradually decreases for a certain time and is turned off.

Then, the brightness of the electro-luminescence diode gradually increases from the start point of the third turn-on pulse $EM_{(n+2)}$ for a certain time. When the brightness increases to the brightness corresponding to the charged data voltage, the brightness is maintained during the remaining third turn-on pulse $EM_{(n+2)}$. However, the present disclosure is not limited thereto, and when the leakage current occurs in the storage capacitor of the sub-pixel 102, a gradual brightness decrease due to the leakage current may be occurred during the third turn-on pulse $EM_{(n+2)}$. When the third turn-on pulse $EM_{(n+2)}$ is turned off, the brightness of the electro-luminescence diode gradually decreases for a certain time and is turned off.

Then, the brightness of the electro-luminescence diode gradually increases from a start point of the fourth turn-on pulse $EM_{(n+3)}$ for a certain time. However, the turn-on duty ratio of the fourth turn-on pulse $EM_{(n+3)}$ has been set very low for illustrative purposes. In this case, the fourth turn-on pulse $EM_{(n+3)}$ is turned off before the brightness reaches the brightness corresponding to the charged data voltage. Accordingly, the brightness of the electro-luminescence diode can be gradually decreased then turned off for a certain time without reaching the brightness corresponding to the charged data voltage. But the present disclosure is not limited thereto, and the turn-on duty ratio of each EM turn-on pulse can be set variously for each frame.

The following description of the $(N+1)^{th}$ frame period is similar to that of the above $(N)^{th}$ frame section except for the duty ratio of the turn-on pulse, and thus redundant description will be omitted for the sake of convenience of explanation. However, the brightness of the electro-luminescence diode with respect to the first turn-on pulse $EM'_n$ and the second turn-on pulse $EM'_{(n+1)}$ in the $(N+1)^{th}$ frame period corresponding to the charged data voltage are similar in that the brightness of the both pulses does not reach up to the intended brightness. However, the duty ratio of the second turn-on pulse $EM'_{(n+1)}$ is relatively higher than the turn-on duty ratio of the first turn-on pulse $EM'_n$. Thus, the second turn-on pulse $EM'_{(n+1)}$ results relatively brighter than the first turn-on pulse $EM'_n$.

The perceived brightness with respect to the human eye may vary depending on the intensity of the light of the displayed image and the light emission time of the displayed image. For example, the user may perceive the brightness of the two images to be substantially the same, if an image is displayed at a refresh rate of 60 Hz with 100 intensity of light for 16.7 ms (e.g., 100% turn-on duty ratio) or with 200 intensity of light for 8.3 ms (e.g., 50% turn-on duty ratio).

That is, the brightness of each frame period perceived by the user can be determined according to the luminance (e.g., intensity of light) value and the specific duty ratio pattern according to the data voltage. Therefore, even if the data voltage and the emission duty ratio pattern are different for each frame period, it is possible to make substantially the same brightness with respect to the user.

For example, even if the luminance value is high, the turn-on duty ratio of the EM signal EM can be reduced to adjust the brightness of one frame section. For example, even if the luminance value is a medium value, the turn-on duty ratio of the EM signal EM can be increased to brighten the brightness of one frame section. In other words, even if the applied data voltages are the same for each frame section, the brightness per frame interval may be different for each frame section according to the turn-on duty ratio of the EM signal EM.

For example, according to an embodiment of the present disclosure, the brightness of the sub-pixel 102 in the $(N)^{th}$ frame period of the electro-luminescence display device 100 may be the area of the luminance waveform measured in the emission period. In other words, FIG. 2 illustrates four luminance waveforms and the user may perceive the brightness of the $(N)^{th}$ frame period which is equal to the sum of the areas of the waveforms.

That is, the brightness perceived by the user can be described by the area of the luminance waveform of each frame section. In other words, the brightness of the frame period is determined according to the level of the data voltage and the specific duty ratio pattern. The Luminance value can be measured with a photodiode, a luminance meter or an optical measuring instrument. But the present disclosure is not limited thereto.

That is, the electroluminescent display device 100 according to an embodiment of the present disclosure can set duty ratios of respective EM turn-on pulses for each emission period. The duty ratio of each EM turn-on pulse can be controlled by allowing the waveform of the EM control signal supplied from the driving unit 130 to include the duty ratio information of the EM turn-on pulse. In other words, the EM control signal includes information on the specific turn-on duty ratio pattern of the EM signal EM.

For example, the scan driver 120 sequentially supplies the EM signal EM to the respective EM lines 110 by receiving the EM control signal for each frame period and determining the specific turn-on duty ratio pattern. At this time, the waveform of the EM control signal may be substantially the same as the waveform of the EM signal EM. That is, the turn-on duty ratio pattern information included in the EM control signal and the turn-on duty ratio pattern of the EM signal EM output from the scan driver 120 correspond to each other. But the present disclosure is not limited thereto.

In some embodiments, the scan driver receives an EM control signal from a driving unit and adjusts the timing (e.g., latch time, delay time, emission duty ratio) and the like, thereby supplying the EM signal EM to the EM lines 110, respectively.

According to an embodiment of the present disclosure, the electroluminescent display device 100 may adjust the turn-on duty ratio of each of the plurality of EM turn-on pulses of the EM signal EM in each frame period.

In detail, it is advantageous that when the turn-on duty ratio is adjusted, dimming level of each frame period can be precisely adjusted.

For example, when the turn-on duty ratio of the first turn-on pulse $EM_n$ is set to 90%, the turn-on duty ratio of the second turn-on pulse $EM_{n+1}$ is set to 80%, the turn-on duty ratio of the third turn-on pulse $EM_{n+2}$ is set to 70% and the turn-on duty ratio of the fourth turn-on pulse $EM_{n+3}$ is set to 60%, then the dimming level can be adjusted without adjusting the level of the data voltage. But the present disclosure is not limited thereto.

For example, when the turn-on duty ratio of the first turn-on pulse $EM_n$ is set to 25%, the turn-on duty ratio of the second turn-on pulse $EM_{n+1}$ is set to 40%, the turn-on duty ratio of the third turn-on pulse $EM_{n+2}$ is set to 70% and the turn-on duty ratio of the fourth turn-on pulse $EM_{n+3}$ is set to 10%, then the dimming level can be adjusted without adjusting the level of the data voltage. But the present disclosure is not limited thereto.

Therefore, it is advantageous that the electroluminescent display device 100 according to the embodiment of the present disclosure can control the turn-on duty ratio of each EM turn-on pulse of the EM signal EM, thereby finely controlling the dimming level.

In detail, the electroluminescent display device 100 according to an embodiment of the present disclosure has an advantage of controlling a specific turn-on duty ratio pattern of the EM signal EM only by adjusting the waveform of the EM control signal. Therefore, it is possible to adjust the dimming level precisely without varying the data voltage. In the above case, since the data voltage adjustment through the video signal processing can be omitted, it is possible to easily adjust the dimming level for each frame period.

In addition, in general, the longer the turn-off period of the electro-luminescence diode is, the better the user can recognize that the electro-luminescence diode is turned on and off and this recognition phenomenon can be defined as flicker.

According to the embodiment of the present disclosure, the electroluminescent display device 100 is configured such that since the EM signal EM includes a plurality of EM turn-on pulses, even if the turn-on duty ratio of each EM turn-pulse is set to be significantly low, the electro-luminescence diode emits light in the number of the predetermined EM turn-on pulses in at least one emission period. Therefore, even if the dimming level is reduced, it is advantageous that the flicker due to the reduction in the turn-on duty ratio can be substantially not recognized to the user.

That is, according to the electroluminescent display device 100 according to the embodiment of the present disclosure, even when the turn-on duty ratio is reduced, the electro-luminescence diodes emit light according to the number of EM turn-on pulses preset in each emission period. Therefore, even if the turn-on duty ratio is reduced, the turn-off period does not substantially increase, thereby the flicker level can be reduced with decreased turn-on duty ratio.

According to an embodiment of the present disclosure, the electroluminescent display device 100 may control the emission duty ratio pattern according to the power consumption control program of the external system or the user's command.

In this case, the driving unit 130 receives the dimming level control signal from the external system and adjusts the overall brightness of the pixel area AA of the electroluminescent display device 100 according to the dimming control signal. And, adjusting the maximum brightness of the electroluminescent display device 100 may be defined as global dimming.

For example, when the maximum brightness of the electroluminescent display device 100 is 1000 nits and the ambient light is dark, the user can feel the current brightness too bright. Therefore, it is necessary to reduce the maximum brightness to 200 nits as an example. For example, when the external system to which the electroluminescent display device 100 is connected operates with battery power, it is necessary to reduce the maximum luminance to 500 nits in order to reduce power consumption as needed. For example, when the ambient light is too bright, it is necessary to increase the maximum brightness to 1000 nits in order to improve the visibility. That is, the target dimming level can be adjusted for various reasons.

A system or external system that indicates this target dimming level may include an operating system (OS). The operating system is operated by a semiconductor chip such as an application processor (AP), a micro computing unit (MCU), or a central processing unit (CPU). But the present disclosure is not limited thereto.

When the target dimming level is adjusted, the electroluminescent display device 100 according to an embodiment of the present disclosure receives the target dimming level determined from the external system. The driving unit 130 controls the duty ratio of the EM control signal corresponding to the current dimming level to the duty ratio of the EM control signal corresponding to the determined target dimming level. Then, the adjusted EM control signal is transmitted to the scan driver 120 through the EM control line 156. The scan driver 120 sequentially outputs an EM signal having an adjusted duty ratio pattern to the plurality of EM lines 110 based on the received EM control signal. That is, the sub-pixel 102 to which the EM signal is applied emits light according to the duty ratio pattern. If the duty ratio, which is the turn-on time of the electro-luminescence diode, increases, the brightness of the electroluminescent display device 100 increases accordingly, and if the duty ratio decreases, the brightness of the electroluminescent display device 100 decreases accordingly.

In some embodiments, the electroluminescent display device may include a circuit unit configured to adjust a maximum voltage value of a gamma voltage curve corresponding to a gray level for adjusting the dimming levels of an electro-luminescent display device and generating an emission (EM) signal having a specific duty ratio pattern for implementing a global dimming, and can be configured to provide fine dimming levels while reducing image flicker by an EM signal having a specific duty ratio pattern. In detail, when the maximum voltage of the gamma voltage curve and the specific duty ratio pattern are applied simultaneously, there is an advantage that finer dimming levels can be realized.

In some embodiments, the circuit unit may be configured to generate an EM signal having a specific duty ratio pattern configured with N number of mutually different PWM waveforms having mutually different duty ratios for adjusting the dimming level to N steps.

In some embodiments, the specific duty ratio pattern of the EM signal generated in the circuit unit includes a duty code configured such that the code of the plurality of turn-on pulses for each image frame period is progressively varied, wherein the code of the plurality of turn-on pulses per image frame period is configured to be non-progressively variable, and the non-progressive duty code can be determined in consideration of the duty code of the adjacent image frame period.

Figure 3:
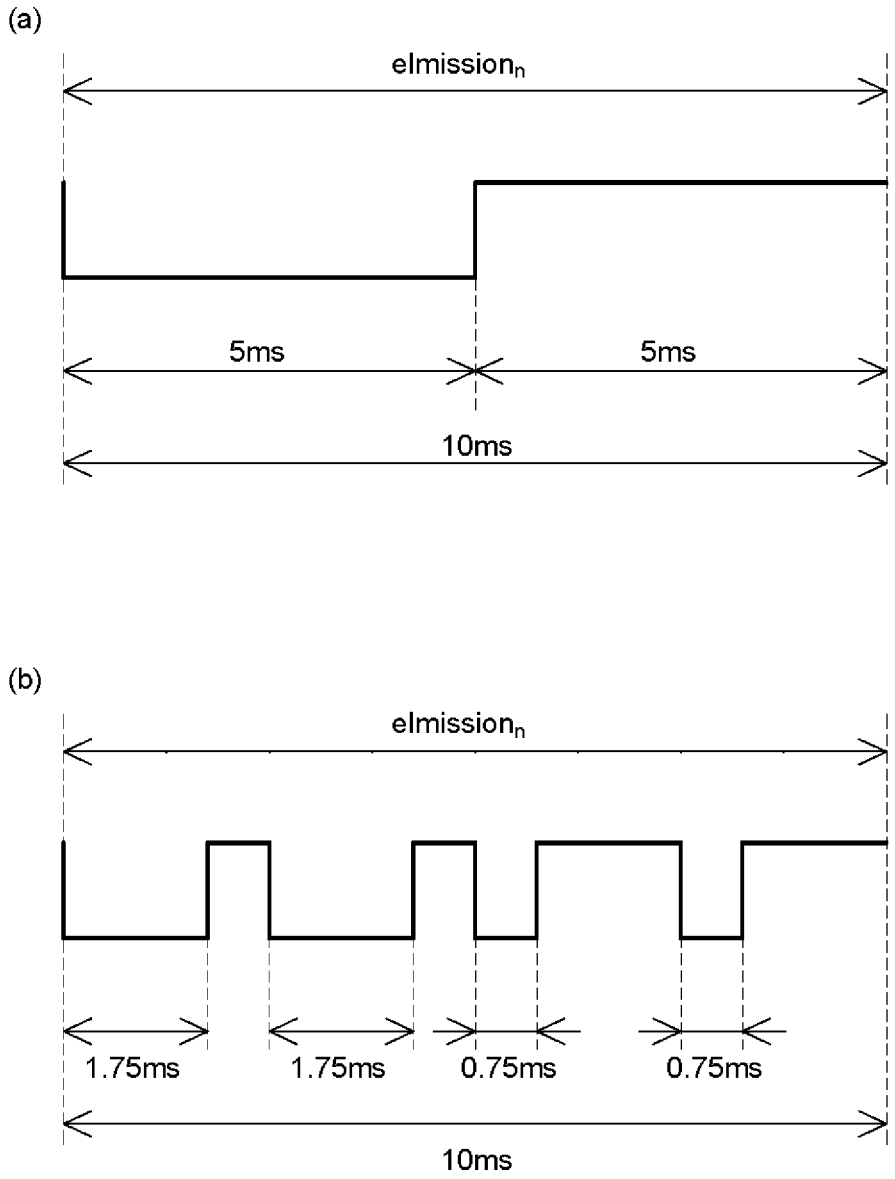
FIG. 3 is a schematic waveform diagram for comparing an electroluminescent display device according to an embodiment of the present disclosure with a comparative example.

FIG. 3 is a schematic waveform diagram for comparing an electroluminescent display device 100 according to an embodiment of the present disclosure and a comparative example 10.

Referring to (a) of FIG. 3, the emission duty ratio of 50% of the electroluminescent display device according to the comparative example is illustrated.

Referring to (b) of FIG. 3, the emission duty ratio pattern of 50% of the electroluminescent display device 100 according to an embodiment of the present disclosure is illustrated.

Even if it is assumed that the data voltage and the emission duty ratio in the emission period are equal to each other, the electro-luminescent display device 100 according to the embodiment of the present disclosure may have a configuration in which a plurality of EM turn-on pulses are arranged with a certain distance in an emission period so as to be turned on, therefore, it is advantageous in that the flicker level can be reduced.

When the turn-on duty ratio of one EM turn-on pulse of the comparative example is 50% and the emission period is 10 ms as an example, the electro-luminescence diode is continuously turned off for 5 ms excluding the programming period.

However, when the emission period of the electroluminescent display device 100 according to an embodiment of the present disclosure is 10 ms, the turn-on duty ratio of two EM turn-on pulses is 70%, and the other two EM turn-On duty ratio of the other two EM turn-on pulses is 30%, then, it is turned on for 1.75 ms, turned off for 0.75 ms, turned on for 1.75 ms, turned off for 0.75 ms, turned on for 0.75 ms, turned off for 1.75 ms, turned on for 0.75 ms, and turned off for 1.75 ms.

That is, the electro-luminescence diode is turned off for a total of 5 ms, but the turn-off periods are substantially distributed. In this case, an embodiment of the present disclosure has an advantage that compared with the comparative example, the ON/OFF of the electro-luminescence diode can be relatively less recognized to the user.

In addition, since the number of the EM turn-on pulses is the same even if the turn-on duty ratio of the emission period is varied, the electroluminescent display device 100 according to an embodiment of the present disclosure can provide a smooth change with respect to the perception in accordance with brightness change.

In some embodiments, it is also possible that the turn-on duty ratio of at least one EM turn-on pulse among the plurality of EM turn-on pulses is set to 0%. In other words, in this case, the actual number of EM turn-on pulses can be adjusted. For example, if the turn-on duty ratio of one of the four EM turn-on pulses is adjusted to 0%, the number of EM turn-on pulses can be three. Therefore, the number of EM turn-on pulses in each frame period may be different.

Figure 4:
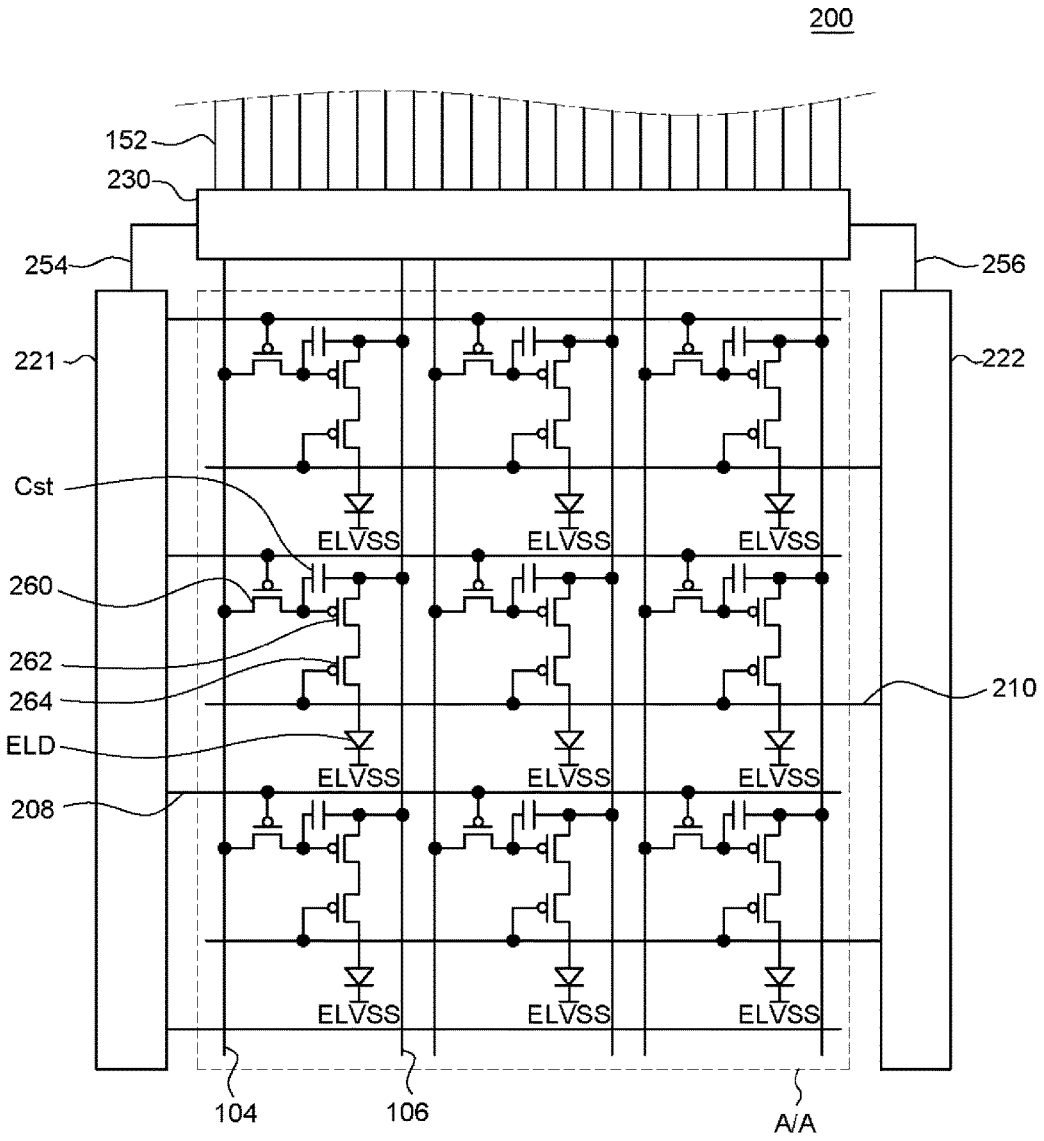
FIG. 4 is a schematic diagram for explaining an electroluminescent display device according to another embodiment of the present disclosure.

FIG. 4 is a schematic diagram for explaining an electroluminescent display device 200 according to another embodiment of the present disclosure.

Referring to FIG. 4, the electroluminescent display device 200 according to another embodiment of the present disclosure may be realized as a top-emission type, a bottom-emission type, or a dual-emission type similar to the electroluminescent display device 100 according to an embodiment of the present disclosure. The electroluminescent display device 200 may be realized as a transparent display device and/or a flexible display device. But the present disclosure is not limited thereto.

To describe the electro-luminescent display device 200 according to another embodiment of the present disclosure, the redundant features, the same or substantially similar elements as those of the electroluminescent display device 100 according to an embodiment of the present disclosure will be omitted for the sake of convenience of explanation.

According to another embodiment of the present disclosure, an electro-luminescent display device 200 is formed on a substrate. A plurality of sub-pixels are configured to include at least a first transistor 260, a second transistor 262, a third transistor 264, a storage capacitor Cst, and an electro-luminescence diode 260 formed on the substrate of the electroluminescent display device 200 according to another embodiment of the present disclosure. For convenience of explanation, the above-described structure may be named, for example, a 3-transistor and 1-capacitor structure (i.e., 3T1C).

For example, the first to third transistors 260, 262, and 264 may be made of a co-planar structure including a buffer layer made of an insulating film for protecting the semiconductor layer from residual impurities and residual hydrogen from the substrate and/or oxygen and moisture permeating through the substrate; a semiconductor layer that can be used as a source electrode, a drain electrode, and a channel of the first to third transistors 260, 262, and 264, which are disposed on the buffer layer; a first metal layer capable of patterning the scan lines 208 and/or the EM lines 210; a gate insulating layer for electrically insulating the semiconductor layer and the first metal layer; a second metal layer capable of patterning the data line 104 and/or the ELVDD line 106; and an interlayer insulating layer for electrically insulating the first metal layer and the second metal layer. Contact holes are formed in the source electrode and the drain electrode of the first to third transistors 260, 262, and 264 to interconnect the first metal layer and the second metal layer. But the present disclosure is not limited thereto.

An over coating layer for planarizing an upper portion of the transistors (i.e., a planarization layer); an anode connected to the transistor; a bank covering the outside of the anode; and an electro-luminescence emission layer disposed between the anode and the cathode to emit light can be formed on the plurality of sub-pixels 102. But the present disclosure is not limited thereto.

In some embodiments, it is also possible that at least one transistor may be configured as an inverted staggered structure.

In some embodiments, it is also possible that at least one transistor is made of an oxide semiconductor layer.

In some embodiments, it is also possible that at least one transistor comprises a low temperature poly silicon (LIPS) semiconductor layer.

In some embodiments, it is also possible that at least one transistor is composed of an oxide semiconductor layer and a low-temperature polysilicon semiconductor layer.

The first transistor 260 is configured to perform the function of a switching transistor. The first transistor 260 is switched by the scan signal SCAN supplied through the scan line 208. The first transistor 260 is operated to charge the data voltage to the storage capacitor.

The second transistor 262 is configured to perform the function of a driving transistor. The gate electrode of the second transistor 262 is electrically connected to one electrode of the storage capacitor Cst. A data voltage may be applied to one electrode of the storage capacitor Cst. The source electrode is electrically connected to the other electrode of the storage capacitor Cst. An ELVDD voltage may be applied to the other electrode of the storage capacitor Cst. The second transistor 232 adjusts the amount of current supplied to the electro-luminescence diode ELD to control the brightness of the ELD. Therefore, the sub-pixel including the electro-luminescence diode ELD can control the amount of current supplied to the electro-luminescent diode ELD according to the level of the data voltage.

The ELVDD line 106 is configured to be electrically connected to the source electrode of the second transistor 262 to supply the high potential ELVDD. And, the cathode electrode of the electro-luminescence diode ELD is configured to supply a low potential voltage ELVSS.

The driving unit 230 of the electroluminescent display device 200 according to another embodiment of the present disclosure is electrically connected to a first scan driver 221, a second scan driver 222, a plurality of sub pixels and a pad line 152. The plurality of data lines 104 electrically connects the first transistors 260 of the plurality of sub-pixels to the driving unit 230.

According to another embodiment of the present disclosure, the first scan driver 221 of the electroluminescent display device 200 is configured to include a plurality of first shift registers. Each first shift register transfers a scan signal SCAN to each scan line 208 sequentially.

According to another embodiment of the present disclosure, the second scan driver 222 of the electroluminescent display device 200 is configured to include a plurality of second shift registers. Each second shift register transfers an EM signal EM to each EM line 210 sequentially.

According to another embodiment of the present disclosure, the scan control line 254 of the electroluminescent display device 200 electrically interconnects the driving unit 230 and the first scan driver 221 and transfers the scan control signal output from the driving unit 230 to the first scan driver 221. And, the driving unit 230 supplies a scan control signal to the first scan driver 221 so that the first scan driver 221 sequentially supplies the scan signal SCAN through the plurality of scan lines 208.

According to another embodiment of the present disclosure, the EM control line 256 of the electroluminescent display device 200 electrically interconnects the driving unit 230 and the second scan driver 222 and transfers the EM control signal output from the driving unit 230 to the second scan driver 222. And, the driving unit 230 supplies the EM control signal to the second scan driver 222 so that the second scan driver 222 sequentially supplies the EM signal EM through the plurality of EM lines 210.

According to another embodiment of the present disclosure, the third transistor 264 of the electroluminescent display device 200 is disposed between the second transistor 262 and the electro-luminescence diode ELD and controls the turn-on duty ratio of the current supplied to the electro-luminescence diode ELD based on the EM signal EM. But the present disclosure is not limited thereto.

In some embodiments, the third transistor may be located between the ELVDD line and the second transistor. In other words, the third transistor is located between the ELVDD line and the electro-luminescence diode ELD, which is the path of the current required for the light emission of the electro-luminescence diode ELD, so that the turn-on duty ratio pattern can be realized.

In some embodiments, at least one of the first to third transistors may be made of an oxide semiconductor, and at least another transistor may be made of a low-temperature polysilicon semiconductor.

In some embodiments, at least one of the first to third transistors may be configured to include both an oxide semiconductor and a low-temperature polysilicon semiconductor layer.

In some embodiments, it may further include an additional period for discharging or initializing the voltage of the previous frame period charged in the electro-luminescence diode and/or the storage capacitor before the programming period as illustrated in FIG. 2, and such period may be referred to as, for example, an initialization period. For the implementation of the above-described configuration, a fourth transistor may be further included, and a line for supplying the initialization voltage may be further included. In this case, the line for supplying the initialization voltage may be connected to the anode electrode of the electro-luminescence diode and/or one electrode of the storage capacitor. But the present disclosure is not limited thereto.

In some embodiments, it may further include an additional period for compensating a threshold voltage deviation ($\Delta$Vth) of the second transistor before the programming period as illustrated in FIG. 2, and such period may be referred to as, for example, a sampling period. For implementation of the above-described configuration, a diode connection configuration may be provided. For example, the fifth transistor may be further included, and the source electrode and the gate electrode of the second transistor may be electrically connected or disconnected according to on-off of the fifth transistor. According to this diode connection, the threshold voltage deviation of the second transistor can be detected. But the present disclosure is not limited thereto.

In some embodiments, the sampling period may be located between the initialization period and the programming period. But the present disclosure is not limited thereto.

According to the above-described configuration, the electroluminescent display device 200 according to another embodiment of the present disclosure can operate substantially the same as the electroluminescent display device 100 according to an embodiment of the present disclosure, this operation has been described above with reference to FIG. 2. In detail, by separating the first scan driver 221 and the second scan driver 222, it is possible to reduce the bezel width differences on both sides of the peripheral area PA.

Figure 5:
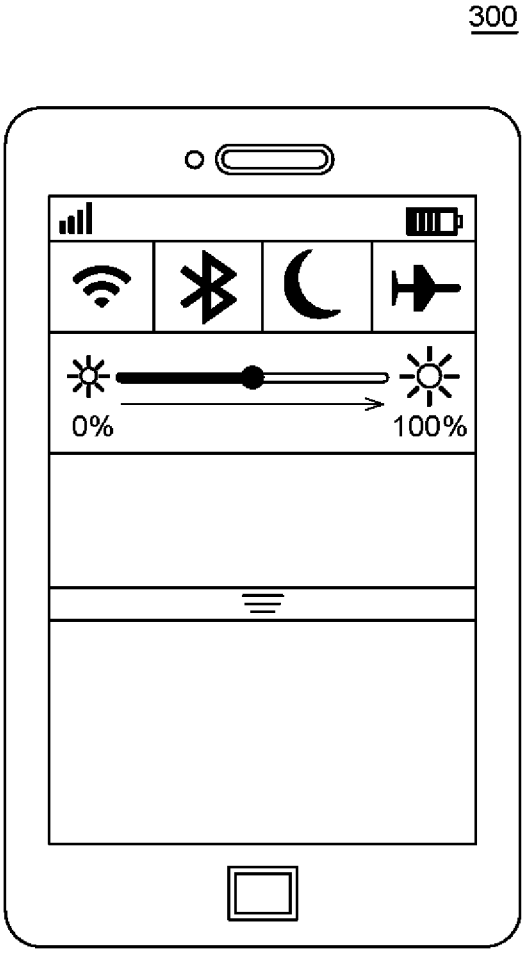
FIG. 5 is a schematic diagram for explaining an exemplary scenario in which an electroluminescent display device is implemented, according to another embodiment of the present disclosure.

FIG. 5 is a schematic diagram for explaining an exemplary scenario in which the electroluminescent display device 300 is implemented according to another embodiment of the present disclosure.

Figure 6:
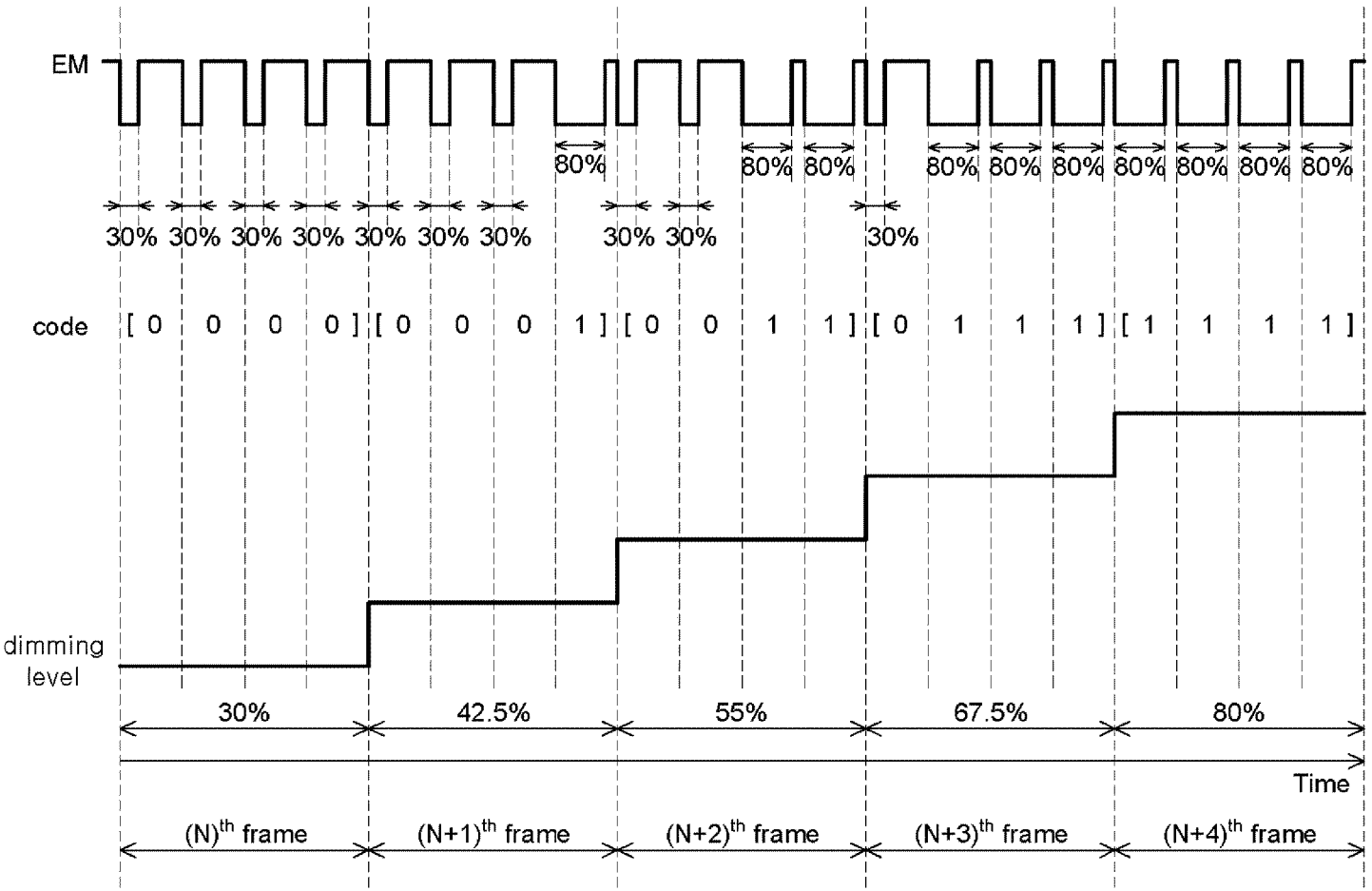
FIG. 6 is a schematic waveform diagram illustrating an exemplary specific duty ratio pattern, duty code, and dimming level when the electroluminescent display device operates in the exemplary scenario as illustrated in FIG. 5, according to another embodiment of the present disclosure.

FIG. 6 is a schematic waveform diagram illustrating an exemplary specific duty ratio pattern, duty code, and dimming level when the electroluminescent display device operates in the exemplary scenario as illustrated in FIG. 5, according to another embodiment of the present disclosure.

It will be described below with reference to FIG. 5 and FIG. 6. For the sake of convenience of explanation, the programming period, Luminance, and the like as illustrated in FIG. 2 will be omitted in FIG. 6. However, it should be noted that there may be at least one period (e.g., a programming period) as illustrated in FIG. 2 between each frames in FIG. 6.

The X-axis in FIG. 6 represents time domain. The EM of the Y-axis means an EM signal EM including a specific duty ratio pattern. The Y-axis code is a value obtained by the coded duty ratio of the EM turn-on pulses. The dimming level of the Y-axis means the dimming level of each frame period according to the duty code of the EM signal EM.

For example, a photodiode, a luminance meter, or anoptical measuring equipment may be used for the dimming level test, measurement and verification of each frame period. Also, for ease of measurement, it is preferable to set the video signal to a specific test pattern.

For example, a particular test pattern may be a mono tone test pattern image. In this case, since the same video signal can be applied to all the sub-pixels in each frame in the same manner, measurement error can be reduced.

In the exemplary scenario of FIG. 5, a case where the user touches the pixel area AA with a finger to increase the dimming level from 0% to 100% will be described. For convenience of explanation, it is assumed that the sliding speed of the user's finger is uniform. But the present disclosure is not limited thereto.

In the exemplary scenario of FIG. 5, as the ambient light becomes brighter, the user may experience an ambient contrast ratio (ACR) of an electronic device (e.g., an external system) including the electroluminescent display device 300 is lowered. Therefore, the visibility of the image displayed in the pixel area AA is reduced by the ambient light. In this case, the user may control so as to increase the brightness of the electronic device including the electroluminescent display device 300, in order to increase the visibility. That is, the user inputs an operation of increasing the screen brightness by touching the screen.

In the scenario described above, the electroluminescent display device 300 according to another embodiment of the present disclosure supplies the coded EM control signal to the scan driver so that the brightness (i.e., the dimming level) of the pixel area can be progressively varied.

Referring to FIG. 6, a specific duty ratio pattern of the electroluminescent display device 300 according to another embodiment of the present disclosure is coded on a frame-by-frame basis.

That is, the encoding means that the duty ratio of each EM turn-on pulse is set to have a specific value. A plurality of coded EM turn-on pulses may be defined by a duty code. The duty code may be composed of "r" EM turn-on pulses and "n" number of duty ratios, that is, n number of codes can be configured. Where r and n are natural numbers greater than or equal to 2. The duty code can be set for each frame period.

According to the duty code, adjustable dimming levels can be determined. The dimming levels according to the duty code can be expressed by [Equation 1].

$$\text{Dimming Levels} = \frac{(n-1+r)!}{(n-1)!r!} \quad \text{[Equation 1]}$$

Where r is the number of EM turn-on pulses present in one frame period and n is the settable steps of the turn-on duty ratio of the EM turn-on pulse.

According to another embodiment of the present disclosure, the EM control signal supplied from the driving unit of the electroluminescent display device 300 to the scan driver includes duty code information. The scan driver outputs an EM signal EM corresponding to the duty code included in the EM control signal for each frame period in accordance with the received EM control signal.

Referring to FIG. 6, an exemplary duty code applied to the $(N)^{th}$ frame period to the $(N+4)^{th}$ frame period is [0000, 0001, 0011, 0111, 1111].

The exemplary duty code described above is progressively changed from one side to the other side according to the dimming control signal.

In some embodiments, the duty code may be [0000, 1000, 1100, 1110, 1111].

The exemplary duty code described above is progressively changed from the other side to one side according to the dimming control signal.

In some embodiments, the duty code may be [0000, 0100, 0110, 0111, 1111].

The exemplary duty code is incrementally changed from center to outward according to the dimming control signal.

That is, the exemplary duty codes are configured to progressively change a duty code of a plurality of turn-on pulses for each frame period.

As an example, according to another embodiment of the present disclosure as illustrated in FIG. 6, the electroluminescent display device 300 is set to have 4 turn-on pulses (i.e., r=4) in one frame period. Also, the number of duty ratios of the EM turn-on pulse was set to 2 ratios (n=2). In this case, the dimming level can be adjusted to five levels according to Equation 1.

$$\text{Dimming Levels} = \frac{(2-1+4)!}{(2-1)!4!} = 5$$

As an example, the first code [0] is set to a turn-on duty ratio of 30% and the second code [1] is set to a turn-on duty ratio of 80%. However, the above-mentioned turn-on duty ratios are merely illustrative and the present disclosure is not limited thereto.

In addition, the duty code applied to the embodiments of the present disclosure is merely for convenience of explanation, and may be represented by special characters, symbols, or may be defined only by a specific turn-on duty ratio (%) values.

The EM turn-on pulse code of the $(N)^{th}$ frame period is [0000]. That is, the turn-on duty ratio of each EM turn-on pulse in the $(N)^{th}$ frame period is [30%, 30%, 30%, 30%]. Therefore, the actual dimming level of the $(N)^{th}$ frame period can be 30%.

The EM turn-on pulse code of the $(N+1)^{th}$ frame period is [0001]. That is, the turn-on duty ratio of each EM turn-on pulse in the $(N+1)^{th}$ frame period is [30%, 30%, 30%, 80%]. Therefore, the actual dimming level of the $(N+1)^{th}$ frame period can be 42.5%.

The EM turn-on pulse code of the $(N+2)^{th}$ frame period is [0011]. That is, the turn-on duty ratio of each EM turn-on pulse in the $(N+2)^{th}$ frame period is [30%, 30%, 80%, 80%]. Therefore, the actual dimming level of the $(N+2)^{th}$ frame period can be 55%.

The EM turn-on pulse code of the $(N+3)^{th}$ frame period is [0111]. That is, the turn-on duty ratio of each EM turn-on pulse in the $(N+3)^{th}$ frame period is [30%, 80%, 80%, 80%]. Therefore, the actual dimming level of the $(N+3)^{th}$ frame period can be 67.5%.

The EM turn-on pulse code of the $(N+4)^{th}$ frame period is [1111]. That is, the turn-on duty ratio of each EM turn-on pulse in the $(N+4)^{th}$ frame period is [80%, 80%, 80%, 80%]. Therefore, the actual dimming level of the $(N+4)^{th}$ frame period can be 80%.

According to the above-described configuration, it is advantageous that the duty code is provided using the EM control signal, so that the EM signal EM can be easily controlled for each frame period. Also, by changing only the duty code of the EM control signal for each frame period, the dimming level of the electroluminescent display device 300 can be adjusted. And, even if the dimming level is reduced, a plurality of turn-on pulses are arranged at specific intervals, therefore, there is an advantage that the flicker can be reduced.

Figure 7:
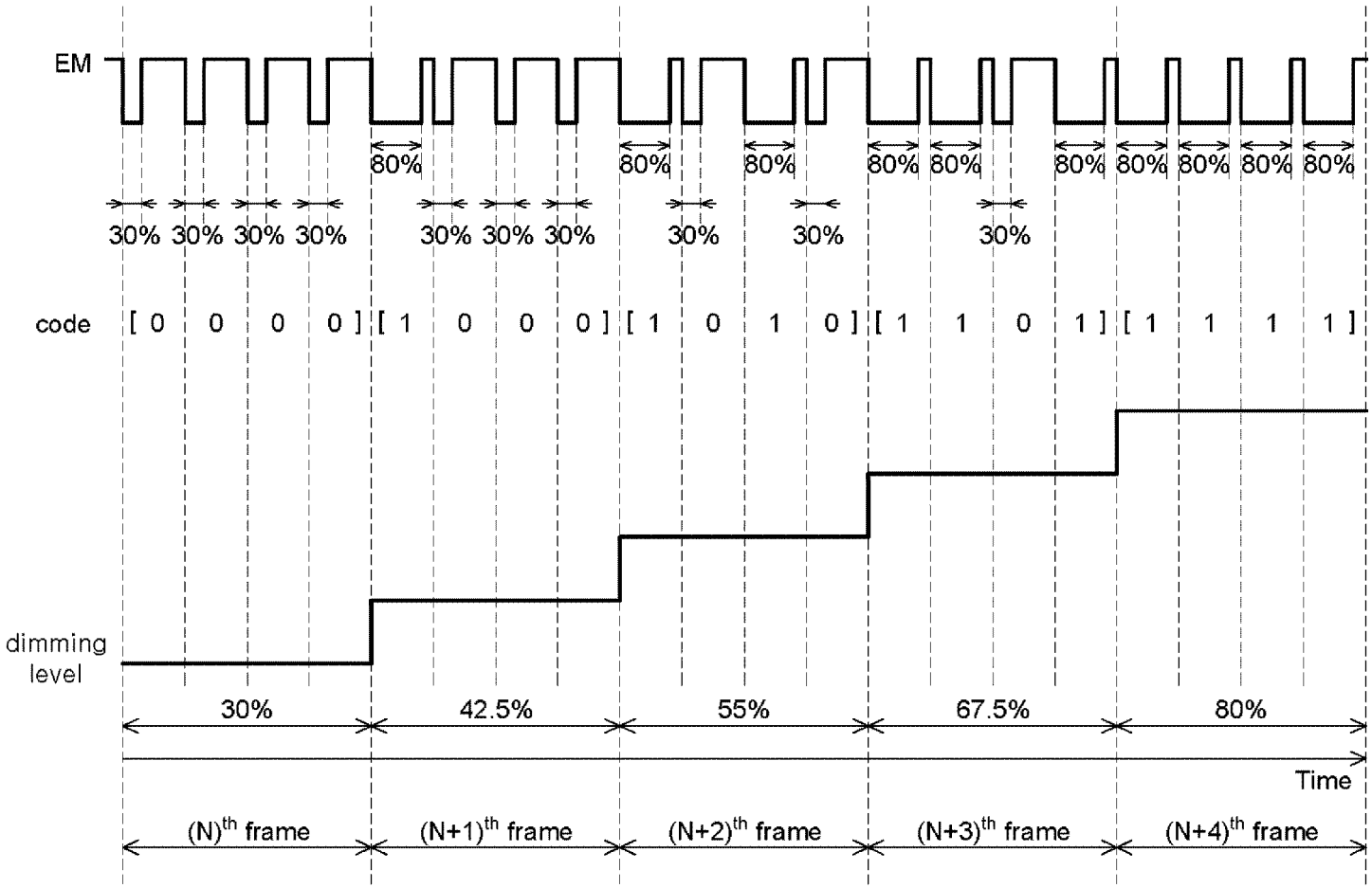
FIG. 7 is a schematic waveform diagram illustrating an exemplary specific duty ratio pattern, duty code, and dimming level when the electroluminescent display device operates in the exemplary scenario as illustrated in FIG. 5, according to another embodiment of the present disclosure.

FIG. 7 is a schematic waveform diagram illustrating an exemplary specific duty ratio pattern, duty code, and dimming level when the electroluminescent display device operates in the exemplary scenario as illustrated in FIG. 5, according to another embodiment of the present disclosure.

The electro-luminescent display device 300 according to another embodiment of the present disclosure as illustrated in FIG. 7 is substantially similar to the electroluminescent display device 300 according to yet another embodiment of the present disclosure as illustrated in FIG. 6 except for the duty code, the redundant features will be omitted for the sake of convenience of explanation.

Referring to FIG. 7, exemplary duty codes applied to the $(N)^{th}$ frame period to the $(N+4)^{th}$ frame period are [0000, 1000, 1010, 1101, 1111].

The non-progressive duty code as illustrated in FIG. 7 is substantially the same to the actual dimming level with respect to the $(N)^{th}$ frame period to $(N+4)^{th}$ frame period as compared to the progressive duty code as illustrated in FIG. 6.

However, the above-mentioned non-progressive duty code has an advantage that the perceived brightness change to the user can be reduced when the dimming level of each frame period is varied, and the flicker can be reduced.

That is, the same turn-on duty ratios, i.e., turn-on pulses having the same code, for each frame period are not continuously arranged. In other words, in the duty code, the duty ratio of a plurality of turn-on pulses for each frame section changes non-progressively.

According to the above-described configuration, the brightness change over a specific time period becomes less noticeable than the progressive duty code. That is, if the turn-on pulses having the same duty code are consecutively applied, the user can perceive that the brightness has changed relatively easily. However, if non-progressive duty code turn-on pulses are applied, the brightness is substantially varied, but the user may not relatively recognize brightness changes. Therefore, when the dimming level is varied by a non-progressive duty code, it is advantageous that the user may perceive a relatively smooth or natural brightness change with reduced flicker level.

In some embodiments, it is set to have 4 (r=4) turn-on pulses in one frame period, and the number of duty ratio of the EM turn-on pulses can be set to 4 (n=4). In this case, the dimming level can be adjusted to 35 steps according to Equation 1.

$$\text{Dimming Levels} = \frac{(4-1+4)!}{(4-1)!4!} = 35$$

For example, the first code [0] may be set to a turn-on duty ratio of 5%. The second code [1] may be set to a turn-on duty ratio of 25%. The third code [2] can be set to a turn-on duty ratio of 60%. The fourth code [3] may be set to a turn-on duty ratio of 90%.

As an example, the duty codes applied to the $(N)^{th}$ frame period to $(N+17)^{th}$ frame period are [0000, 1000, 1010, 1101, 1111, 1121, 1221, 2221, 2222, 2322, 2323, 3323, 3333, 3334, 4343, 4433, 4344, 4444]. But the present disclosure is not limited thereto.

That is, there is an advantage that the dimming level can be subdivided by dividing the duty code. According to the above-described configuration, even if the dimming level changes greatly, there is an advantage that the dimming level change can be smoothly displayed and the flicker level can be reduced.

In addition, controlling the dimming level with the duty code can facilitate complicated dimming level control, and there is an advantage that the simulation can be facilitated during product design stage.

In some embodiments, the electroluminescent display device may analyze the user's control behavior in real time (e.g., analyze the acceleration or speed when touching the slide of the UI of FIG. 5 with a finger touch), thereby generating the optimal dimming code in real time. Thus, the dimming level of the electroluminescent display device can be controlled by the generated dimming code.

Figure 8:
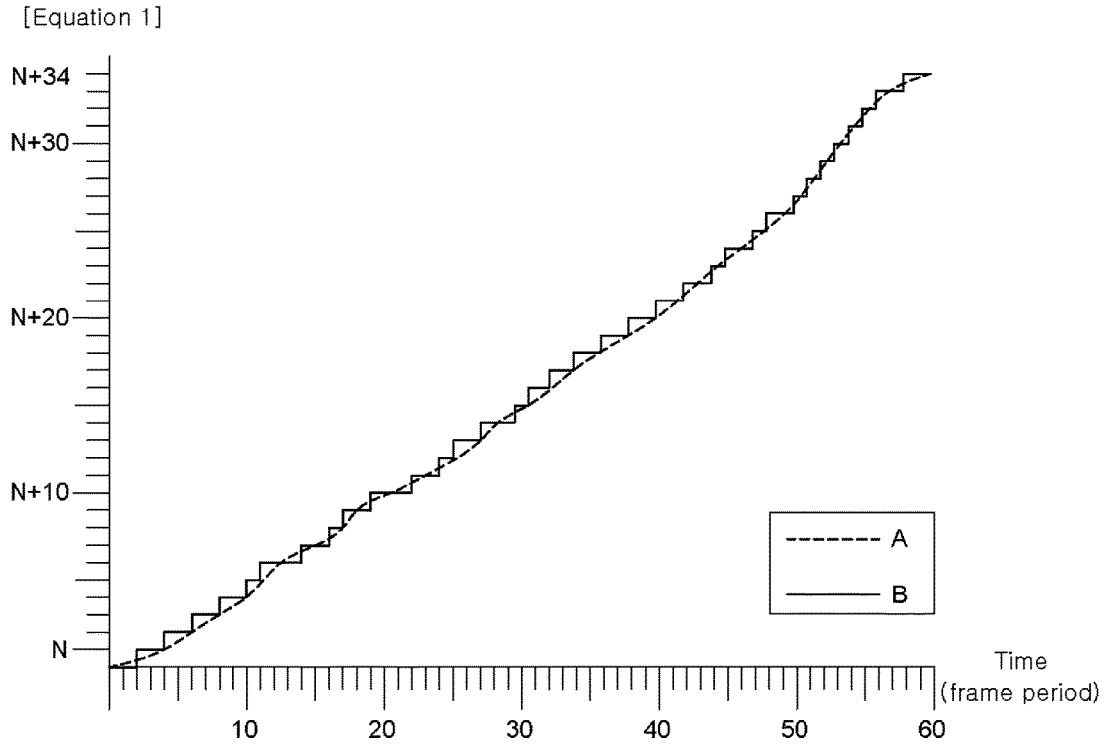
FIG. 8 is a graph illustrating control of dimming levels according to exemplary duty codes in embodiments of the present disclosure.

FIG. 8 is a graph illustrating control of dimming levels according to exemplary duty codes in embodiments of the present disclosure.

The X-axis in FIG. 8 represents time domain (in unit of frame period). The Y-axis represents the dimming level. The dimming level of the Y-axis can be implemented with a duty code set based on Equation 1. For example, the dimming level may be 35 steps, where N is a natural number greater than 0.

The dotted line (A) indicates the dimming level input by the user. In the case of the dotted line (A), the characteristic that the speed of the sliding finger is variable when the user changes the dimming level, is illustrated.

The solid line (B) indicates an embodiment of inputting a duty code capable of providing a dimming level corresponding to the input of the dotted line (A) using a preset duty code. Since the user input scenario has been described with reference to FIG. 5, redundant description will be omitted.

The electroluminescent display device according to another embodiment of the present disclosure has an advantage that the dimming level corresponding to the user input in real time can be controlled by using the predetermined duty code.

In detail, when the dimming level is abruptly changed by the user input, the change in the EM duty ratio becomes large, so that the flicker can be easily recognized. In this case, the driving unit may optionally provide a non-progressive duty code for a particular frame period.

That is, the driving unit may be configured to selectively select the progressive duty code and the non-progressive duty code according to the degree of change of the dimming level.

In some embodiments, it is also possible to store not only the user's input but also a predetermined duty code in a memory according to a specific dimming scenario, and to provide the predetermined duty code at the time of a specific event.

The embodiments of the present disclosure can also be described as follows:

According to an embodiment of the present disclosure, there is provided an electroluminescent display device which comprises a pixel area including a plurality of sub-pixels displaying an image signal at a specific refresh rate, a plurality of ELVDD lines electrically connected to the plurality of sub-pixels, a plurality of data lines electrically connected to the plurality of sub-pixels, a plurality of scan lines electrically connected to the plurality of sub-pixels, a plurality of EM lines electrically connected to the plurality of sub pixels, a scan driver sequentially supplying a scan signal to the plurality of scan lines and sequentially supplying an EM signal having a specific duty ratio pattern configured to control a dimming level of the pixel area to the plurality of EM lines, and a driving unit electrically connected to the plurality of data lines and the scan driver and configured to control the dimming level according to a dimming control signal.

The driving unit may supply a data voltage corresponding to the scan signal to the plurality of data lines in a programming period. And the driving unit may adjust the specific duty ratio pattern of the EM signal in response to the dimming control signal in an emission period after the programming period.

The EM signal may include a plurality of turn-on pulses capable of adjusting a turn-on duty ratio in the emission period.

Turn-on duty ratios of the plurality of turn-on pulses of the EM signal may be set different from each other.

Each of the plurality of sub-pixels may include an electroluminescence diode that emits light corresponding to the specific duty ratio pattern of the EM signal.

The driving unit includes a data driver for generating the data voltage.

The driving unit may further comprise a timing controller for controlling the data driver.

The scan driver may include a gate driver for outputting the scan signal and an EM driver for outputting the EM signal.

The gate driver may be on a first side of the pixel area.

The EM driver may be on a second side facing the first side of the pixel area.

A refresh rate of the EM signal may be higher than a refresh rate of the image signal.

The electroluminescent display device may further comprise an EM control line electrically connected the driving unit and the scan driver.

The driving unit may supply an EM control signal to the scan driver through the EM control line.

The turn-on duty ratio of the EM control signal and the turn-on duty ratio of the EM signal may correspond to each other.

The EM control signal may include information with respect to the specific duty ratio pattern of the EM signal.

The driving unit may control the EM control signal to output the number of the plurality of turn-on pulses of the EM signal differently for each frame period.

The number of the plurality of turn-on pulses may be reduced by setting the turn-on duty ratio of at least one turn-on pulse to 0%.

The scan driver may further include a first scan driver and a second scan driver.

The first scan driver may be on a first side of the pixel area and the second scan driver may be on the opposite side of the first side of the pixel area.

The electroluminescent display device may further include a system. The driving unit receives the dimming control signal from the system and controls the dimming level in units of frames sections in response to the dimming control signal.

The specific duty ratio pattern may be a specific duty code.

The duty code may be configured such that a code of a plurality of turn-on pulses for each frame section is progressively variable.

The duty code may be configured such that a code of a plurality of turn-on pulses for each frame section is non-progressively variable.

A non-progressive duty code may be determined in consideration of a duty code of an adjacent frame section.

According to another embodiment of the present disclosure, there is provided an electroluminescent display device which may comprise a circuit unit adjusting a maximum voltage value of a gamma voltage curve corresponding to a gray level for varying a dimming level of the electroluminescent display device and generating an EM signal having a specific duty ratio pattern for realizing a global dimming. The EM signal having the specific duty ratio pattern provides a fine dimming level while reducing image flicker.

The circuit unit may generates the EM signal having the specific duty ratio pattern so that the EM signal having the specific duty ratio pattern is made of n PWM waveforms having different duty ratios for adjusting the dimming level in n steps, wherein n is a natural number greater than or equal to 2.

The specific duty ratio pattern of the EM signal generated by the circuit unit may include a duty code progressively varied a code of a plurality of turn-on pulses for each image frame section. The duty code may be configured such that the code of a plurality of turn-on pulses for each image frame section is non-progressively variable. And the duty code may be determined in consideration of another duty code of an adjacent image frame section.

Although the embodiments of the present disclosure have been described in detail with reference to the accompanying drawings, the present disclosure is not limited thereto and may be embodied in many different forms without departing from the technical concept of the present disclosure. Therefore, the embodiments of the present disclosure are provided for illustrative purpose only but not intended to limit the technical concept of the present disclosure. The protective scope of the present disclosure should be construed based on the following claims and all the technical concepts in the equivalent scope thereof should be construed as falling within the scope of the present disclosure.

What is claimed is:

1. An electroluminescent display device comprising:

a pixel area including a plurality of sub-pixels displaying an image signal at a specific refresh rate;

a plurality of ELVDD lines electrically connected to the plurality of sub-pixels;

a plurality of data lines electrically connected to the plurality of sub-pixels;

a plurality of scan lines electrically connected to the plurality of sub-pixels;

a plurality of EM lines electrically connected to the plurality of sub pixels;

a scan driver sequentially supplying a scan signal to the plurality of scan lines and sequentially supplying an EM signal having a specific duty ratio pattern configured to control a dimming level of the pixel area to the plurality of EM lines; and a driving circuit electrically connected to the plurality of data lines and the scan driver and configured to control the dimming level according to a dimming control signal, wherein in at least one frame period, the specific duty ratio pattern includes a plurality of turn-on pulses of different turn-on duty ratios.

2. The electroluminescent display device of claim 1, wherein the driving circuit supplies a data voltage corresponding to the scan signal to the plurality of data lines in a programming period, and wherein the driving circuit adjusts the specific duty ratio pattern of the EM signal in response to the dimming control signal in an emission period after the programming period.

3. The electroluminescent display device of claim 2, wherein the EM signal includes the plurality of turn-on pulses capable of adjusting a turn-on duty ratio among the turn-on duty ratios in the emission period.

4. The electroluminescent display device of claim 3, wherein turn-on duty ratios of the plurality of turn-on pulses of the EM signal are set different from each other.

5. The electroluminescent display device of claim 3, wherein each of the plurality of sub-pixels includes an electro-luminescence diode that emits light corresponding to the specific duty ratio pattern of the EM signal.

6. The electroluminescent display device of claim 1, wherein the driving circuit includes a data driver for generating the data voltage.

7. The electroluminescent display device of claim 6, wherein the driving circuit further includes a timing controller for controlling the data driver.

8. The electroluminescent display device of claim 1, wherein the scan driver includes a gate driver for outputting the scan signal and an EM driver for outputting the EM signal.

9. The electroluminescent display device of claim 8, wherein the gate driver is on a first side of the pixel area.

10. The electroluminescent display device of claim 8, wherein the EM driver is on a second side facing the first side of the pixel area.

11. The electroluminescent display device of claim 1, wherein a refresh rate of the EM signal is higher than a refresh rate of the image signal.

12. The electroluminescent display device of claim 1, further comprising an EM control line electrically connected the driving circuit and the scan driver.

13. The electroluminescent display device of claim 12, wherein the driving circuit supplies an EM control signal to the scan driver through the EM control line.

14. The electroluminescent display device of claim 13, wherein the turn-on duty ratio of the EM control signal and the turn-on duty ratio of the EM signal correspond to each other.

15. The electroluminescent display device of claim 13, wherein the EM control signal includes information with respect to the specific duty ratio pattern of the EM signal.

16. The electroluminescent display device of claim 3, wherein the driving circuit further controls the EM control signal to output the number of the plurality of turn-on pulses of the EM signal differently for each frame period.

17. The electroluminescent display device of claim 16, wherein the number of the plurality of turn-on pulses is reduced by setting the turn-on duty ratio of at least one turn-on pulse to 0%.

18. The electroluminescent display device of claim 1, wherein the scan driver further includes a first scan driver and a second scan driver.

19. The electroluminescent display device of claim 18, wherein the first scan driver is on a first side of the pixel area and the second scan driver is on the opposite side of the first side of the pixel area.

20. The electroluminescent display device of claim 1, further comprising a system, wherein the driving circuit receives the dimming control signal from the system and controls the dimming level in units of frames sections in response to the dimming control signal.

21. The electroluminescent display device of claim 20, wherein the specific duty ratio pattern is a duty code.

22. The electroluminescent display device of claim 21, wherein the duty code is configured such that a code of the plurality of turn-on pulses for each frame section is progressively variable.

23. The electroluminescent display device of claim 21, wherein the duty code is configured such that a code of the plurality of turn-on pulses for each frame section is non-progressively variable.

24. The electroluminescent display device of claim 23, wherein a non-progressive duty code is determined in consideration of a duty code of an adjacent frame section.

25. An electroluminescent display device comprising:

a circuit unit adjusting a maximum voltage value of a gamma voltage curve corresponding to a gray level for varying a dimming level of the electroluminescent display device and generating an EM signal having a specific duty ratio pattern for realizing a global dimming, wherein the EM signal having the specific duty ratio pattern provides a fine dimming level while reducing image flicker, and wherein in at least one frame period, the specific duty ratio pattern includes a plurality of turn-on pulses of different turn-on duty ratios.

26. The electroluminescent display device of claim 25, wherein the circuit unit generates the EM signal having the specific duty ratio pattern so that the EM signal having the specific duty ratio pattern is made of n PWM waveforms having different duty ratios for adjusting the dimming level in n steps, wherein n is a natural number greater than or equal to 2.

27. The electroluminescent display device of claim 26, wherein the specific duty ratio pattern of the EM signal generated by the circuit unit includes a duty code that is one of progressively variable or non-progressively variable determined in consideration of another duty code of an adjacent image frame section.

* * * * *